US009820905B2

(12) United States Patent
Bullock

(10) Patent No.: US 9,820,905 B2
(45) Date of Patent: Nov. 21, 2017

(54) BED SHEET LIFT SYSTEM

(71) Applicant: Science Medical, LLC, Saratoga Springs, UT (US)

(72) Inventor: Jeff Bullock, Eagle Mountain, UT (US)

(73) Assignee: Science Medical, LLC, Saratoga Springs, UT (US)

( * ) Notice: Subject to any disclaimer, the term of this patent is extended or adjusted under 35 U.S.C. 154(b) by 0 days.

(21) Appl. No.: 15/255,079

(22) Filed: Sep. 1, 2016

(65) Prior Publication Data

US 2017/0056268 A1 Mar. 2, 2017

Related U.S. Application Data

(60) Provisional application No. 62/213,008, filed on Sep. 1, 2015.

(51) Int. Cl.

| | |
|---|---|
| ***A61G 7/10*** | (2006.01) |
| ***A61G 1/01*** | (2006.01) |
| ***A61G 1/048*** | (2006.01) |

(52) U.S. Cl.

CPC ..... *A61G 7/1055* (2013.01); *A61G 1/01* (2013.01); *A61G 1/048* (2013.01); *A61G 7/1015* (2013.01)

(58) Field of Classification Search

CPC ..... A61G 1/01; A61G 1/044; A61G 1/048; A61G 7/1023; A61G 7/1026; A61G 7/1051; A61G 7/1055; A61G 7/1015; B66C 1/122; A47G 9/0238; A47G 9/04

See application file for complete search history.

(56) References Cited

U.S. PATENT DOCUMENTS

| | | | | |
|---|---|---|---|---|
| 3,761,973 | A | 10/1973 | Leventhal | |
| 4,021,870 | A | 5/1977 | Walters | |
| 4,675,925 | A | 6/1987 | Littleton | |
| 4,744,115 | A * | 5/1988 | Marchione | A61G 7/1026 5/81.1 T |
| 5,005,232 | A * | 4/1991 | Wright | A61G 7/1019 5/81.1 C |
| 5,249,320 | A | 10/1993 | Moretz et al. | |
| 5,271,110 | A * | 12/1993 | Newman | A61G 7/103 5/625 |

(Continued)

FOREIGN PATENT DOCUMENTS

| | | |
|---|---|---|
| GB | 2189993 | 11/1989 |
| GB | 2484885 | 5/2012 |

*Primary Examiner* — Nicholas Polito

(74) *Attorney, Agent, or Firm* — David R. Conklin; Kirton McConkie

(57) ABSTRACT

The present invention includes a bed sheet having one or more features to accommodate a user's grasp whereby to assist the user in safely lifting a patient with the bed sheet. The invention further includes a hoist system configured to raise and lower the bed sheet via the one or more features to accommodate a user's grasp. The one or more grasping features of the bed sheet may include handles that are secured to the bed sheet using an integrated webbing that allows the bed sheet to be used to transport patients from one location to another, such as from a gurney to a hospital bed. An integrated webbing of the bed sheet strengthens an interface between handles and a top portion of the bed sheet so that patients of substantial weight can be transported via the bed sheet.

11 Claims, 25 Drawing Sheets

(56) References Cited

U.S. PATENT DOCUMENTS

| | | | | |
|---|---|---|---|---|
| 5,978,989 | A * | 11/1999 | Chavez | A61G 1/01 294/140 |
| 6,341,393 | B1 * | 1/2002 | Votel | A61G 7/1019 5/484 |
| 6,658,676 | B1 * | 12/2003 | Persson | A61G 7/1026 5/81.1 HS |
| 7,849,533 | B1 | 12/2010 | Receveur et al. | |
| 2007/0056096 | A1 | 3/2007 | Assink | |
| 2011/0119831 | A1 * | 5/2011 | Rincon | A61G 1/01 5/627 |
| 2012/0053545 | A1 | 3/2012 | Love et al. | |

* cited by examiner

BED SHEET LIFT SYSTEM

RELATED APPLICATIONS

This application claims priority to U.S. Provisional Patent Application Ser. No. 62/213,008, entitled BED SHEET HAVING LIFTING HANDLES, filed on Sep. 1, 2015, which is incorporated herein by reference in its entirety.

BACKGROUND OF THE INVENTION

When a medical patient is confined to a bed, it is oftentimes necessary to reposition the patient within the bed or transport the patient from the bed to a different location. To accomplish such repositioning or transport, medical personnel will sometimes employ a bed sheet to lift the patient. This is typically performed by grabbing a portion of the bed sheet and possibly wrapping the bed sheet around the wrist or hand while lifting. Although lifting in this manner can be effective, it can also result in injury to the medical personnel such as back and knee injury, broken fingers, wrist dislocations, carpal tunnel, and other hand or wrist injuries. Lifting may further result in patient injury due to falling or slipping. Generally, use of the patient's bed sheet to reposition or move the patient is unstable and unsafe. Accordingly, many hospitals and health care facilities have "zero-lift programs" that prohibit health care workers from manually lifting and transferring patients.

BRIEF SUMMARY OF THE INVENTION

According to some embodiments, a lift system may include a bed sheet and/or a hoist configured to raise and lower the bed sheet. In some embodiments, the bed sheet may have handles that are secured to the bed sheet using an integrated webbing that allows the bed sheet to be used to transport patients from a bed to another location. The integrated webbing may strengthen the interface between the handles and a top portion of the bed sheet so that patients of substantial weight can be transported within the bed sheet. The handles may be located on lengthwise edges of the top portion of the bed sheet and may have a loop shape.

In some embodiments, the lift device may include one or more lengthwise tension rods that may be parallel to the lengthwise edges of the top portion of the bed sheet. The lengthwise tension rods may extend through the handles and may increase rigidity and stability along a length of the top portion as a patient is transported.

In some embodiments, the lift device may include one or more widthwise tension rods that may be perpendicular to the lengthwise edges of the top portion of the bed sheet. The widthwise tension rods may be coupled with the top portion of the bed sheet and may increase rigidity and stability along a width of the top portion as a patient is transported.

In some embodiments, the hoist may include support straps, which may be coupled to the handles and/or the lengthwise tension rods. In some embodiments, the bed sheet may include one or more extensions that each extend along at least a portion of a particular lengthwise edge of the top portion of the bed sheet. In some embodiments, the support straps of the hoist may be coupled with the extensions.

In some embodiments, a particular bed sheet may be configured for use with both a first bed and a second bed. In some embodiments, the first bed may include a gurney. In some embodiments, the second bed may include any bed larger than the first bed, such as, for example, a hospital bed, etc. In some embodiments, the particular bed sheet may be configured to facilitate carrying or transfer of the patient from the first bed to the second bed and/or may be used with both the first and second beds without having to remove the patient from the particular bed sheet.

In some embodiments, the particular bed sheet may include one or more of the following components: a first sheet, a second sheet, a third sheet, and a support structure. In some embodiments, the third sheet may be sized and configured to cover an upper surface of the first bed. For example, a size of the third sheet may be approximately equal to an upper surface of a gurney. In some embodiments, edges of the third sheet may be aligned with edges of the first bed when the third sheet lays flat across the first bed. In some embodiments, the second sheet may be sized equal or similar to the third sheet.

In some embodiments, the first sheet may be larger than the second and/or third sheets. In some embodiments, when the particular bed sheet is placed on the first bed with the third sheet on top or facing upward and/or the first sheet on bottom or facing downward, the second sheet and/or the third sheet may be aligned with or approximately cover the upper surface of the first bed, and the first sheet may extend or hang over sides of the first bed. In these and other embodiments, edges of the first sheet may be secured underneath the first bed. For example, the edges of the first sheet may be tucked underneath the first bed.

In some embodiments, when the particular bed sheet is placed on the second bed, the second sheet and/or the third sheet may be smaller than an upper surface of the second bed, and a size of the first sheet may allow the upper surface of the second bed to be covered. In some embodiments, the particular bed sheet may be placed on the second bed with the third sheet on the bottom or facing downward. Alternatively, in some embodiments, the particular bed sheet may be placed on the second bed with the third sheet on the top or facing upward and/or the first sheet on the bottom or facing downward, which may allow transfer of the patient from the first bed to the second bed without removal of the patient from the particular bed sheet.

In some embodiments, one or more of the following: the first sheet, the second sheet, the third sheet, and the support structure, may be coupled together via any suitable means of coupling, such as, for example, sewing, stitching, fasteners, adhesive, Velcro®, etc. In some embodiments, the particular bed sheet may be layered in the following order: the first sheet, the second sheet, the support structure, and the third sheet.

In some embodiments, the support structure may be coupled with one or more of the following: the first sheet, the second sheet, and the third sheet. In some embodiments, the support structure may include at least two longitudinal portions that extend along lengthwise edges of the second sheet and/or the third sheet. In some embodiments, the longitudinal portions may create a taut or tight edge to prevent the patient from rolling out of the particular bed sheet when the patient is being transported in the particular bed sheet. In some embodiments, the support structure may include multiple U-shaped portion, which may be disposed proximate the longitudinal portions. In some embodiments, each of the U-shaped portions may extend beyond a length of the second and/or third sheets.

In some embodiments, the support structure may include one or more looped portions, which may extend perpendicularly to the U-shaped and/or longitudinal portions. In some embodiments, the looped portions may extend across a width of the second and/or third sheets. Each of the looped portions may include one or more handles. In some embodiments, each of the looped portions may include one or more divider portions the may extend along a length of the looped portion and divide the looped portion to form multiple handles. In some embodiments, the handles of the looped portion may be disposed between the lengthwise edge of the second sheet and a lengthwise edge of the first sheet. In some embodiments, the looped portions may include one or more outer handles and/or one or more inner handles, similar to the U-shaped portions. The multiple handles may facilitate easy transfer of the particular bed sheet from one medical personnel to another when transporting the patient.

In some embodiments, the U-shaped portions may each include one or more outer handles and/or one or more inner handles. In some embodiments, the U-shaped portions may each include an outer handle and an inner handle. In some embodiments, compared to the outer handle of a particular U-shaped portion, the inner handle of the particular U-shaped portion may be disposed inwardly with respect to the particular bed sheet. In some embodiments, the outer handle of the particular U-shaped portion may be aligned with or just inwardly from a widthwise edge of the first sheet.

The outer handle and the inner handle may allow the medical personnel transporting the patient on the particular bed sheet to use the outer handle or the inner handle depending, for example, on a size of a space through which they are transporting the patient and may prevent injury of the medical personnel. In some embodiments, the inner handle may be angled, which may prevent physical discomfort of the medical personnel transporting the patient and may improve efficiency. The multiple outer and/or inner handles may facilitate easy transfer of the particular bed sheet from one medical personnel to another when transporting the patient.

In some embodiments, an inner edge of the U-shaped portion, disposed towards a middle of the particular bed sheet, may extend parallel to the longitudinal portion. In some embodiments, the inner edge of the U-shaped portion may terminate at the divider portion of a particular looped portion. In some embodiments, a support element may be coupled with the divider portion along an entire length or a portion of the entire length of the divider portion. In some embodiments, the support element may include a strap or a strip of flexible material.

In some embodiments, the divider portion and/or the support element may be coupled with each of the first sheet, the second sheet, and the third sheet along an entire length of the divider portion and/or the support element that overlaps with the first sheet, the second sheet, and the third sheet. For example, the divider portion and/or the support element may be sewn or stitched to each of the first sheet, the second sheet, and the third sheet along the entire length of the divider portion and/or the support element that overlaps with the first sheet, the second sheet, and the third sheet. In some embodiments, the handles of the looped portions and/or portions of the divider portion and/or the support element that do not overlap with the second sheet and/or the third sheet may not be coupled with other components of the particular bed sheet and may be movable with respect to the other components of the particular bed sheet, which may enable a hand and/or wrist to reach in and grip a particular handle.

Similarly, in some embodiments, the outer and inner handles of the U-shaped portions may not be coupled with other components of the particular bed sheet and may be movable with respect to the other components of the particular bed sheet, which may enable a hand and/or wrist to reach in and grip a particular outer or inner handle.

In some embodiments, ends of the longitudinal portions disposed between the U-shaped portion and the divider portion may be coupled with each of the first sheet, the second sheet, and the third sheet. In these and other embodiments, all components of the particular bed sheet may not be coupled together along central portions of the longitudinal portions, disposed between the ends of the longitudinal portions. In some embodiments, the inner edge of the each of the U-shaped portions may be coupled with each of the first sheet, the second sheet, and the third sheet. In some embodiments, all or a portion of an inner edge of each of the looped portions may be coupled with each of the first sheet, the second sheet, and the third sheet.

BRIEF DESCRIPTION OF THE SEVERAL VIEWS OF THE DRAWINGS

In order that the above-recited and other features and advantages of the invention are obtained and will be readily understood, a more particular description of the invention briefly described above will be rendered by reference to specific embodiments thereof, which are illustrated in the appended drawings. These drawings depict only typical embodiments of the invention and are not therefore to be considered to limit the scope of the invention.

DETAILED DESCRIPTION OF THE INVENTION

The presently preferred embodiments of the described invention will be best understood by reference to the Figures, wherein like reference numbers indicate identical or functionally similar elements. It will be readily understood that the components of the present invention, as generally described and illustrated in the Figures, could be arranged and designed in a wide variety of different configurations. Thus, the following more detailed description, as represented in FIGS. 1 through 17B, is not intended to limit the scope of the invention as claimed, but is merely representative of some presently preferred embodiments of the invention.

According to some embodiments, a bed sheet may have handles that are secured to the bed sheet using an integrated webbing that allows the bed sheet to be used to transport patients from a bed to another location. The integrated webbing strengthens the interface between the handles and the top portion of the bed sheet so that patients of substantial weight can be transported within the bed sheet.

As used herein, the term "bed" is understood to describe any surface that is capable of supporting a body, and for which it is customary to cover the surface with a sheet or other type of protective material. For example, the term "bed" may include a gurney, a stretcher, a table, an examination table, an operating table, a bed, or other similar surface. Further, the term "bed sheet" as herein is understood to describe generally any sheet or other type of protective material that is used to cover at least a portion of a bed, as described herein.

Figure 1:
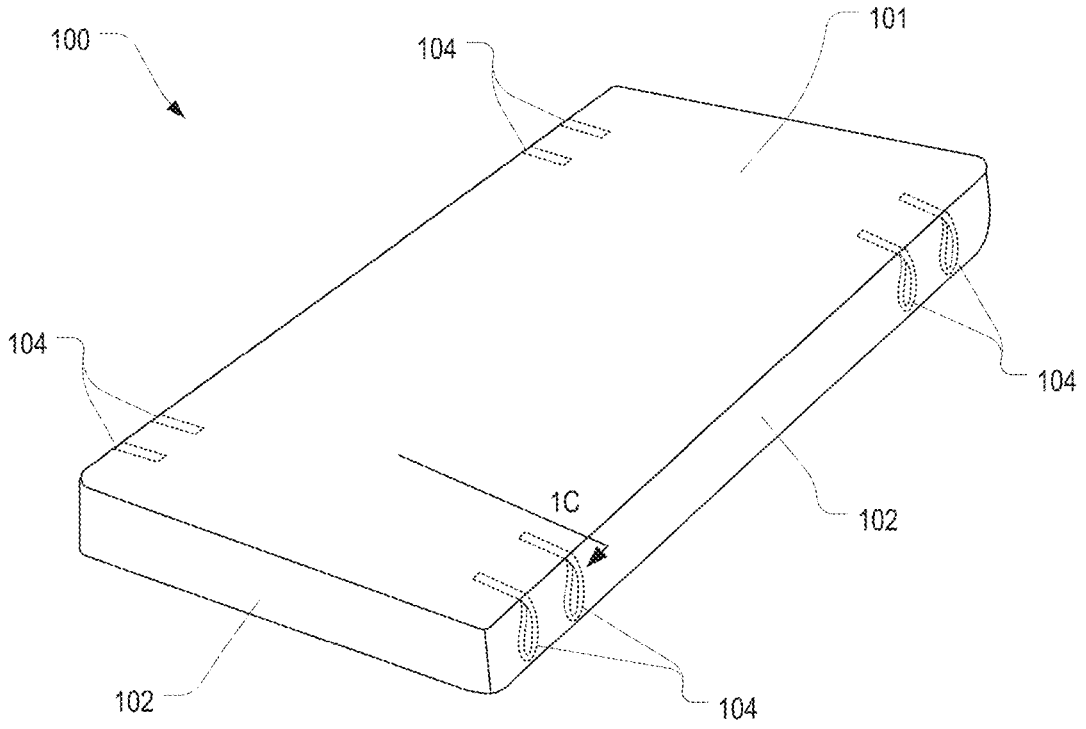
FIG. 1 illustrates a perspective top view of a bed sheet having handles in accordance with one or more embodiments of the present invention.

FIG. 1 illustrates a first example of a bed sheet 100 that is configured in accordance with one or more embodiments of the present invention. As shown, bed sheet 100 includes a top portion 101 (i.e., the portion on which the patient lays) and a sidewall 102 that is connected along the edges of top portion 101. Bed sheet 100 is therefore an example of a fitted sheet. It is noted, however, that a bed sheet in accordance with embodiments of the present invention can also be configured as a flat sheet. In such embodiments, the depicted sidewall 102 can be viewed as the periphery of top portion 101. Accordingly, the present invention should not be limited to a fitted sheet.

Some embodiments of bed sheet 100 comprise a top portion 101 consisting of a single layer. In other embodiments, bed sheet 100 comprises two or more layers of top portion 101, wherein the additional layers increase the overall strength of top portion 101.

For purposes of this specification and the claims, the sides of the bed sheet should be construed as the portions of the bed sheet that would be positioned along the sides of a bed. Similarly, the ends of the bed sheet should be construed as the portions of the bed sheet that would be positioned along the head and foot of the bed. In a typical-sized hospital bed, the sides of the sheet would be longer than the top and bottom of the sheet. However, a bed sheet in accordance with embodiments of the present invention should not be limited to any particular size.

As shown in FIG. 1, bed sheet 100 includes four pairs of handles 104. Each handle 104 is secured to the underside of top portion 101 as indicated by handles 104 being drawn in phantom. Accordingly, to expose handles 104 for use, sidewall 102 could be lifted up away from the sides of the bed. Once handles 104 are exposed, medical personnel (or other individuals) could use handles 104 to lift the patient (or other individual) while the patient is contained within top portion 101.

Figure 1A:
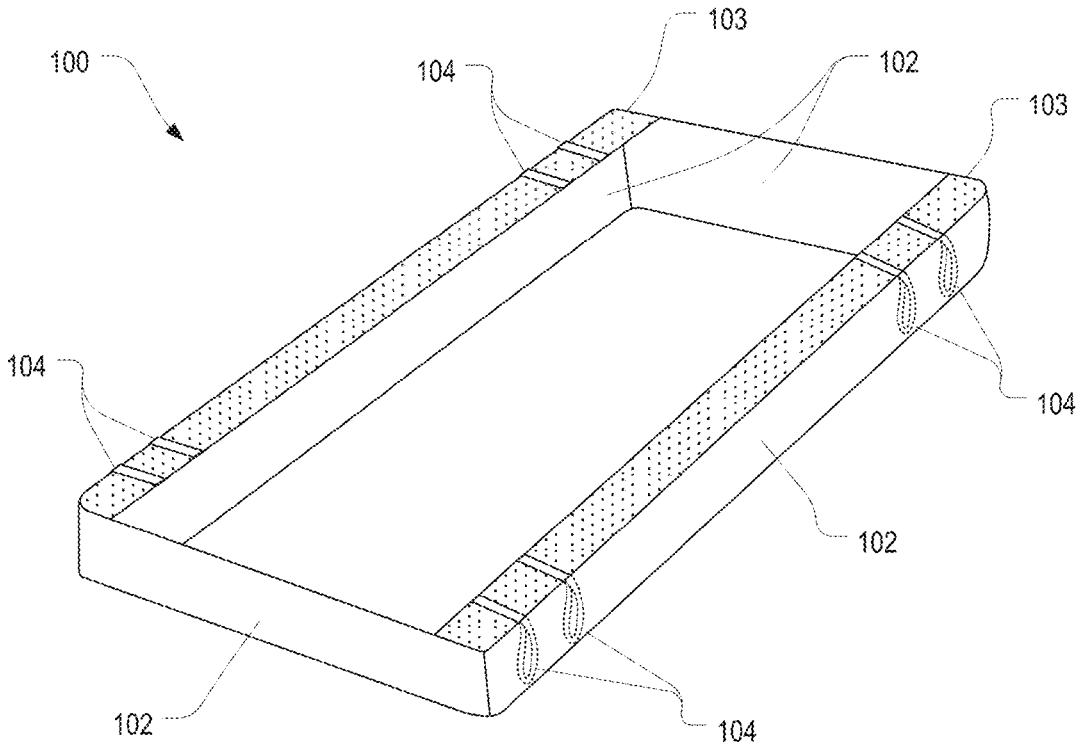
FIG. 1A illustrates a perspective top view of the bed sheet of FIG. 1 with the top portion of the bed sheet removed.

To allow bed sheet 100 to be used to transport a patient, bed sheet 100 can include a webbing 103 that reinforces the connection between handles 104 and top portion 101. FIG. 1A illustrates an example of how webbing 103 could be integrated into bed sheet 100. In FIG. 1A, bed sheet 100 is shown without top portion 101 to allow webbing 103 to be seen. As shown, webbing 103 comprises strips of material that extend along the sides of top portion 101. Webbing 103 can be attached to top portion 101 in any suitable manner. For example, webbing 103 may typically be sewn to top portion 101 along the length of top portion 101 to ensure a strong connection.

FIG. 1A also shows that a top portion of handles 104 is secured to webbing 103. For example, the portion of handles 104 may be sewn on top of webbing 103. In this way, handles 104 can be strongly secured to top portion 101 via top portion 101's connection to webbing 103. In the depicted embodiment, webbing 103 is shown as extending the full length of top portion 101 which can enhance the distribution of weight along the length of top portion 101 thereby minimizing the likelihood that top portion 101 may rip during transport of a patient.

Figure 1B:
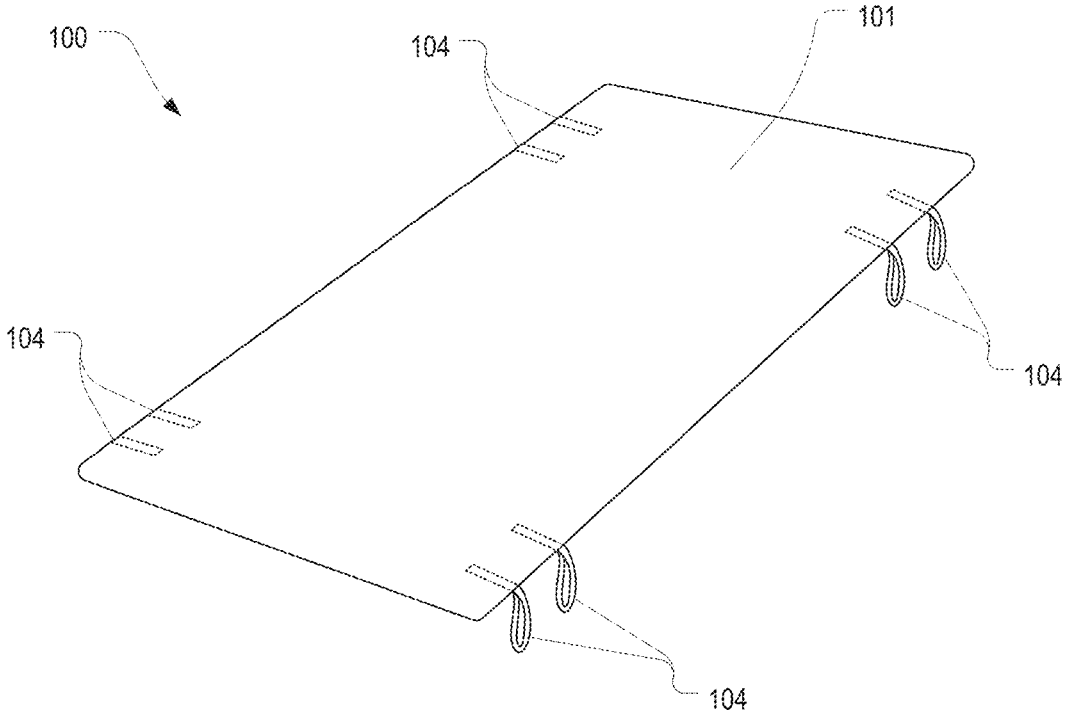
FIG. 1B illustrates a perspective top view of the bed sheet of FIG. 1 with the sidewalls of the bed sheet removed.

FIG. 1B illustrates bed sheet 100 with sidewall 102 removed. As shown, handles 104 are configured as loops. These loops are configured such that they will be covered by sidewall 102 when bed sheet 100 is placed on a bed. In this way, handles 104 are less likely to catch on a structure when a bed is transported but remain easily accessible by simply lifting up sidewall 102. The loop shape of handles 104 can facilitate lifting of a patient without placing excessive strain on the hands or wrists of the medical personnel or other lifter. In particular, the medical personnel (of which, in this embodiment, there would be four) may insert their wrists and/or hands through the loop portion of handles 104. The loop portion of handles 104 may then be secured around the wrists and/or hand so that weight is more evenly distributed towards the larger muscles of the upper arms. This is in contrast to simply grabbing a portion of the bed sheet in the hands, which places excessive force on the fingers and wrist. Accordingly, the loop-shaped design of handles 104 can facilitate lifting while also minimizing the risk of injury.

Also, because handles 104 are positioned in pairs, the weight can be more evenly distributed between both arms. In some embodiments, a pair of handles 104 may be spaced close enough to allow the medical personnel to insert each arm in opposite directions through both handles so that the weight can be supported by the overlapping forearms. In this way, a large portion of the weight can be supported by the shoulders and biceps of the medical personnel. It is noted, however, that the present invention also extends to embodiments where handles 104 are not positioned in pairs. For example, bed sheet 100 could alternatively be configured with four handles 104 with one handle at each corner of the bed sheet.

Figure 1C:
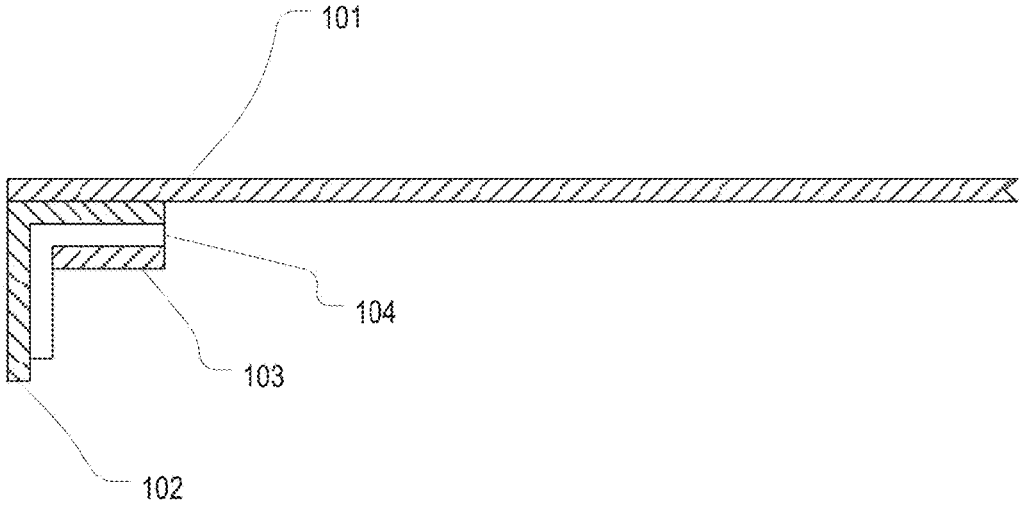
FIG. 1C illustrates a cross-sectional view of one embodiment of the bed sheet of FIG. 1 in which the handles are positioned between the top portion of the bed sheet and the webbing.
Figure 1D:
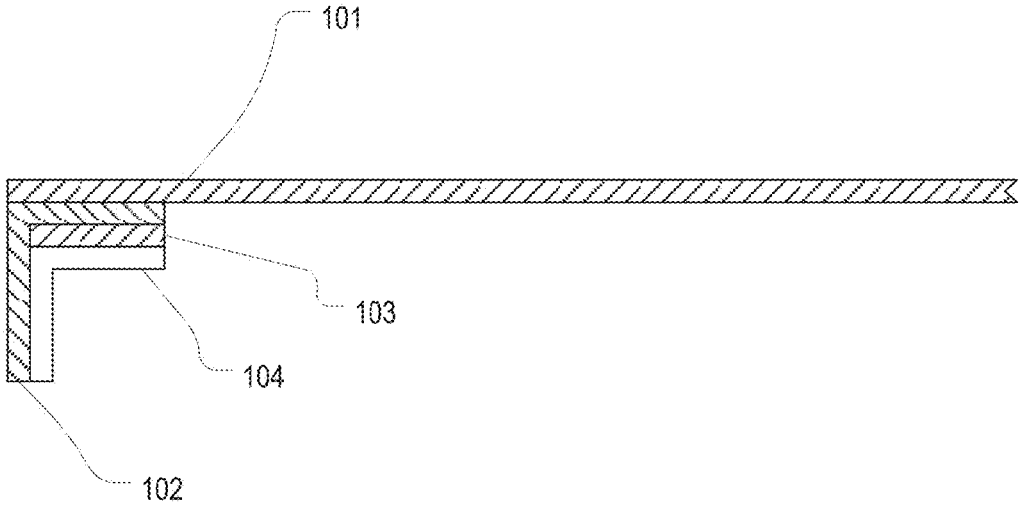
FIG. 1D illustrates a cross-sectional view of another embodiment of the bed sheet of FIG. 1 in which the handles are positioned below the webbing.

FIGS. 1C and 1D each illustrate different layerings of components of bed sheet 100. It is noted that these figures are not drawn to scale. In FIG. 1C, handle 104 is shown as being sandwiched between sidewall 102 and webbing 103. Although sidewall 102 is shown as extending under top portion 101 the same distance as the other components, sidewall 102 could equally extend a shorter distance. Also, sidewall 102 could also be secured to the top side of top portion 101. In any case, the manner in which sidewall 102 is secured to top portion 101 is not essential to the invention. Further, in embodiments where bed sheet 100 is a flat sheet, sidewall 102 would not be a separate component than top portion 101. FIG. 1D illustrates an alternate layering in which handles 104 are secured to the underside of webbing 103. It is noted that these are merely two example layerings and any suitable layering could be employed. Also, the distances to which handles 104 and webbing 103 extend into the interior of top portion 101 could differ. For example, webbing 103 could be wider or narrower than is shown in FIGS. 1C and 1D. Preferably, webbing 103 would have a width/area sufficient to allow the full length of the top portion of handles 104 to be secured thereto.

Figure 2:
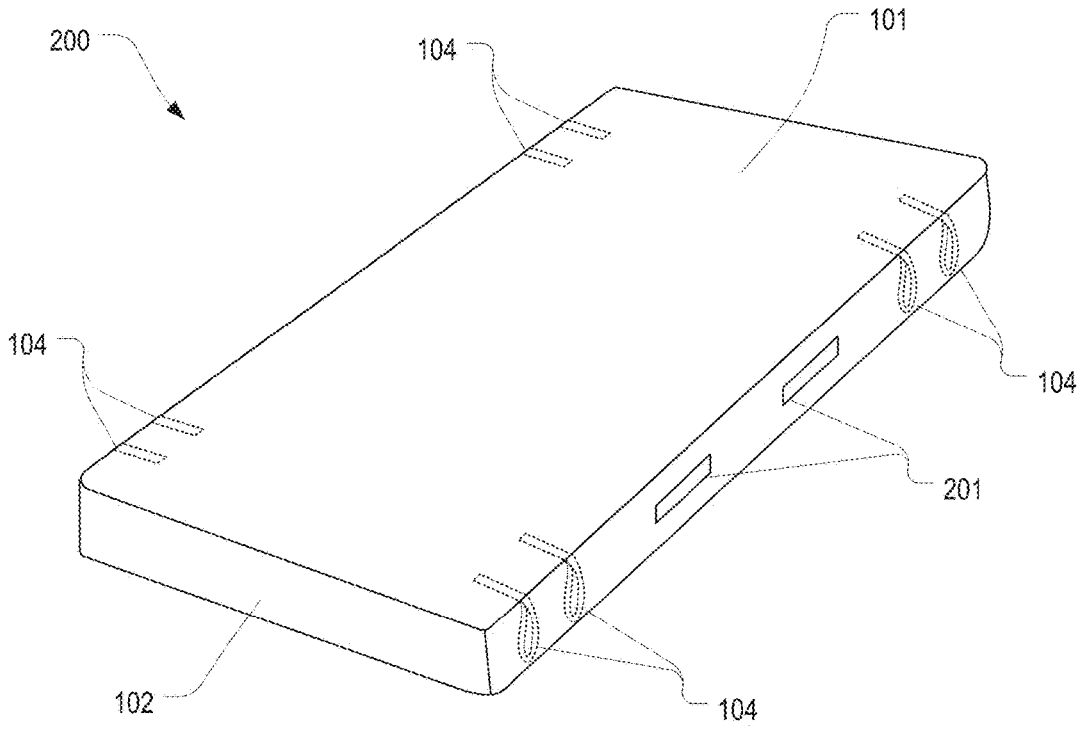
FIG. 2 illustrates a perspective top view of a bed sheet having handles and air vents in accordance with one or more embodiments of the present invention.

FIG. 2 illustrates another embodiment of a bed sheet 200 having handles 104. Bed sheet 200 is similar to bed sheet 100 except that sidewall 102 of bedsheet 200 includes one or more vents 201. Vents 201 can be positioned within sidewall 102 so as to align with corresponding vents formed in a mattress on which bed sheet 200 may be placed. As such, vents 201 prevent air from becoming trapped between bedsheet 200 and the mattress.

Figure 3:
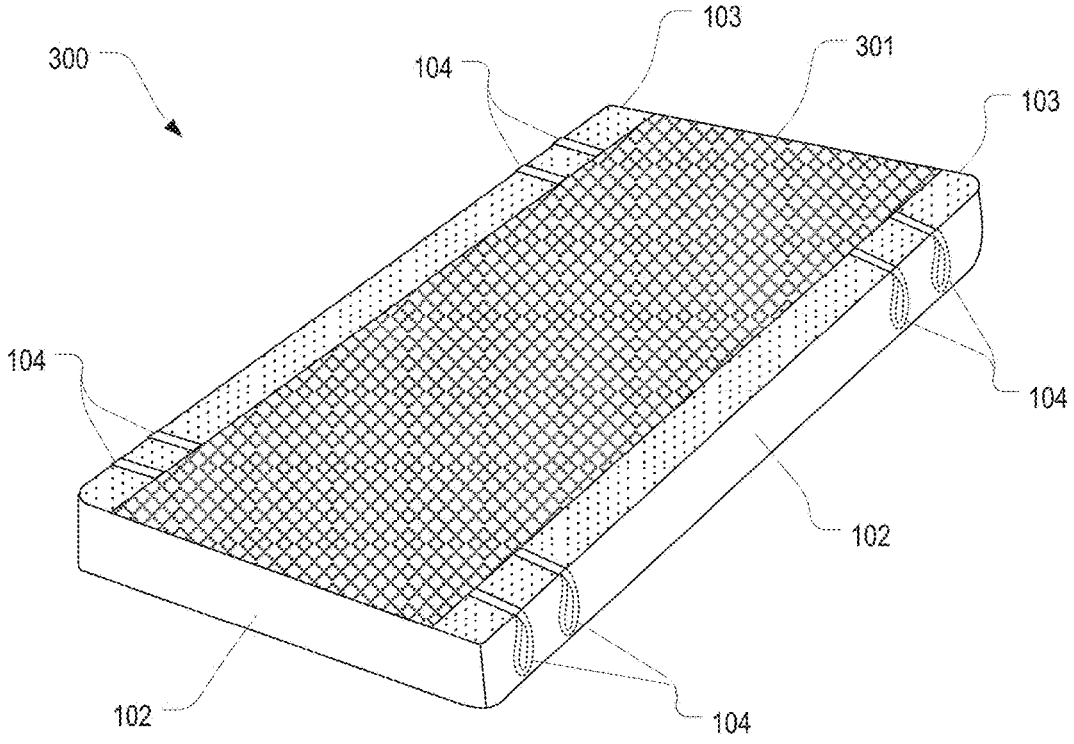
FIG. 3 illustrates a perspective top view of a bed sheet with the top portion removed where the bed sheet has handles and an integrated netting in accordance with one or more embodiments of the present invention.

FIG. 3 illustrates another embodiment of a bed sheet 300 having handles 104. Bed sheet 300 is similar to bed sheet 100 except that bed sheet 300 includes a netting 301 that extends underneath top portion 101 (which is not shown to allow the underlying components to be visible). Netting 301 can be used to reinforce top portion 101 of bed sheet 300 thereby allowing bed sheet 300 to be used to transport patients of significant weight.

Figure 3A:
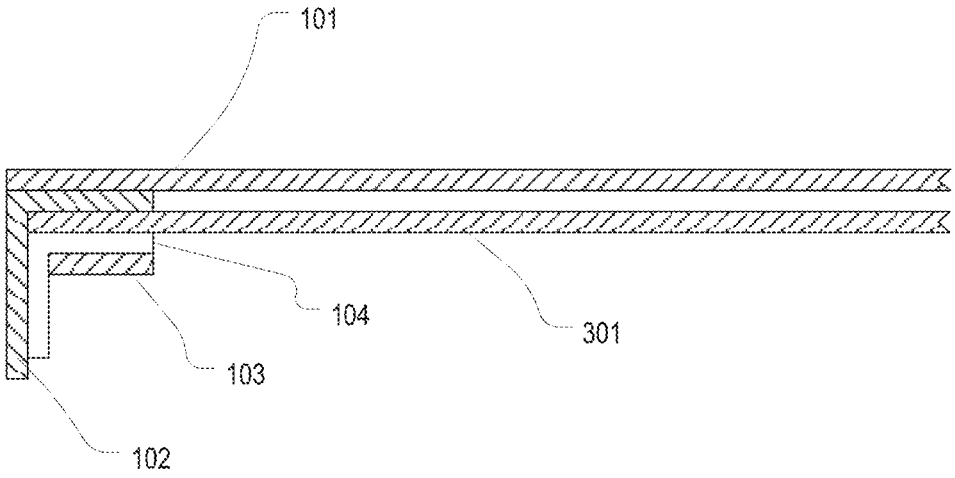
FIG. 3A illustrates a cross-sectional view of one embodiment of the bed sheet of FIG. 3 in which the netting is positioned under the top portion of the bed sheet and the handles are positioned between the netting and the webbing.
Figure 3B:
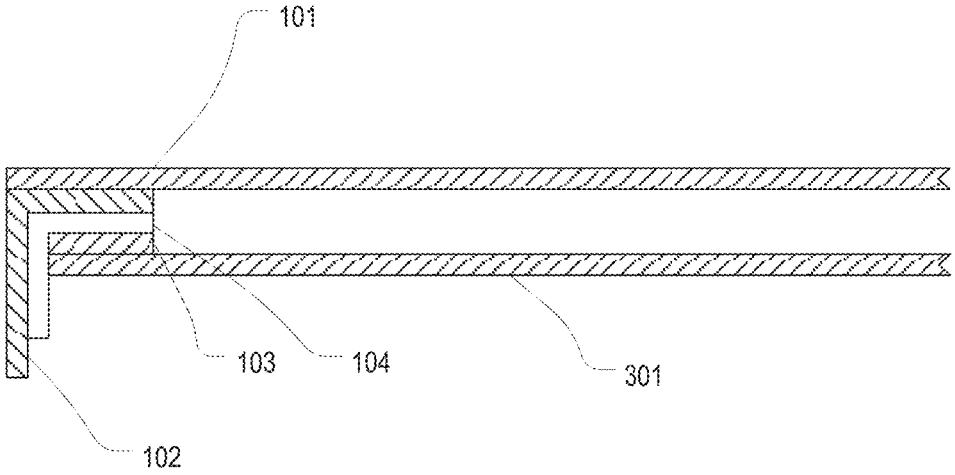
FIG. 3B illustrates a cross-sectional view of one embodiment of the bed sheet of FIG. 3 in which the handles are positioned between the top portion of the bed sheet and the webbing while the netting is positioned below the webbing.

FIGS. 3A and 3B illustrate two possible ways in which netting 301 could be secured to top portion 101. In FIG. 3A, netting 301 is shown as being secured between top portion 101/sidewall 102 and handles 104/webbing 103. In contrast, in FIG. 3B, netting 301 is shown as being positioned underneath webbing 103. Alternatively, netting 301 may be positioned directly underneath top portion 101. In any layering, netting 301 can be secured to webbing 103 so that the combination of webbing 103 and netting 301 can provide substantial reinforcement to top portion 101. In some embodiments, a single stitch may be employed to secure each component depicted in FIGS. 3A and 3B or FIGS. 1C and 1D (e.g., by sewing through all components at the same time). In other embodiments, multiple stitches may be employed (e.g., by first combining subsets of the components and then combining the subsets).

In some embodiments, some of the components of the bed sheet may be made of different materials. For example, in some instances various components of the bed sheet may be recyclable, and other various components may be biodegradable. In other embodiments, the various components of the bed sheet may comprise different types of recyclable materials for which separation and sorting is required prior to recycling. Accordingly, to facilitate disposing of the bed sheet, the components may be interconnected in a manner that facilitates separation of the components. For example, a chain stitch (which is commonly used on sacks of food products, such as flour or dog food) can be employed. In such cases, a tab or other structure can be secured to the end of the stitch to facilitate the removal of the stitch and the separation of components. In this way, the components of different materials can be separated and disposed of properly such as by separating the different materials according to their recycling codes and/or by separating biodegradable materials from recyclable materials.

In some embodiments, top portion 101 (and possibly sidewall 102) can be formed of a polyester-based material or of a biodegradable material (e.g., a cotton-based material) while the remaining components (i.e., webbing 103, handles 104, netting 301, and possibly sidewall 102) can be formed of a polypropylene material. In such cases, top portion 101 can be configured to be easily separated from the other components for independent recycling. In some embodiments, at least some of the components (including top portion 101) can be formed of lyocell (which is the generic term for Tencel®) or other similar biodegradable material. Polypropylene may be used for webbing 103 and netting 301 due to its strength. In some embodiments, the webbing 103 and/or the netting 301 may include one or more of the following: polyamide, nylon, polyester, and polypropylene. In some embodiments, handles 104 may be formed of a rubber material.

In some embodiments, the materials of the bed sheet are selected to provide a single-use bedsheet. In other embodiments, the materials of the bed sheet are selected to provide a reusable bed sheet.

Figure 4:
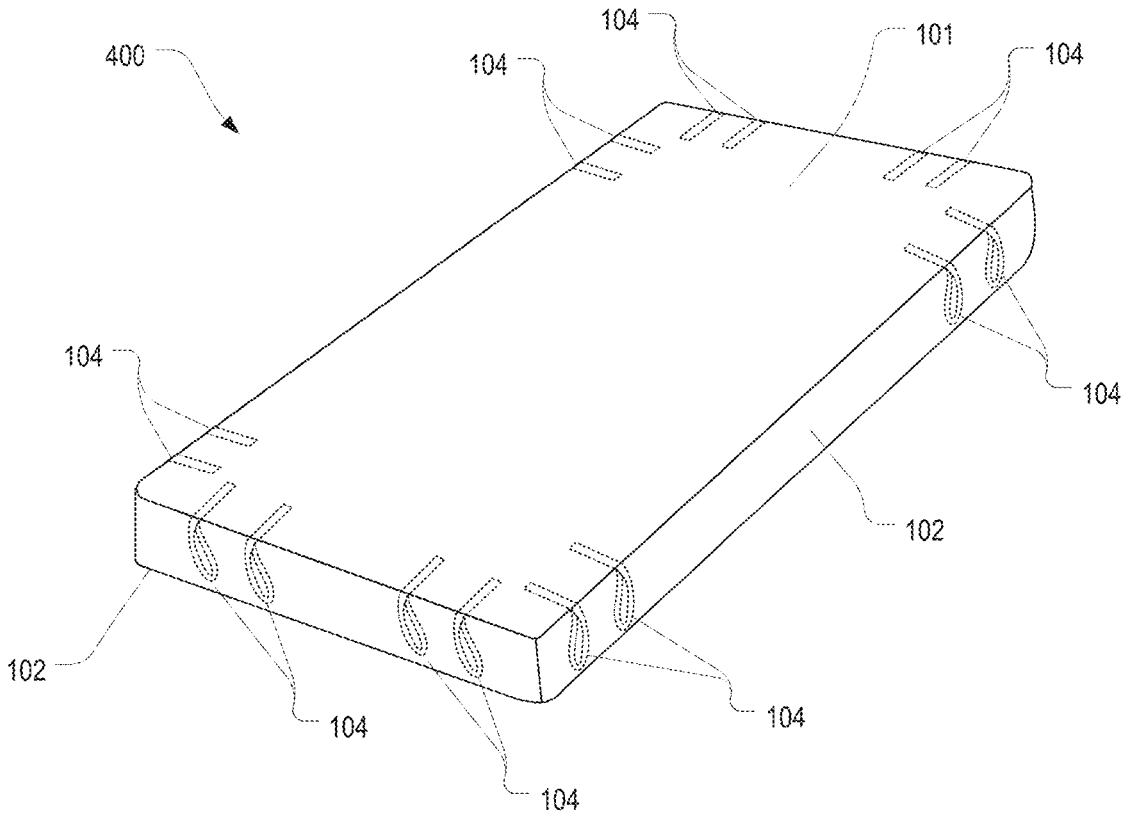
FIG. 4 illustrates a perspective top view of a bed sheet having handles on sides and ends of the bed sheet in accordance with one or more embodiments of the present invention.
Figure 4A:
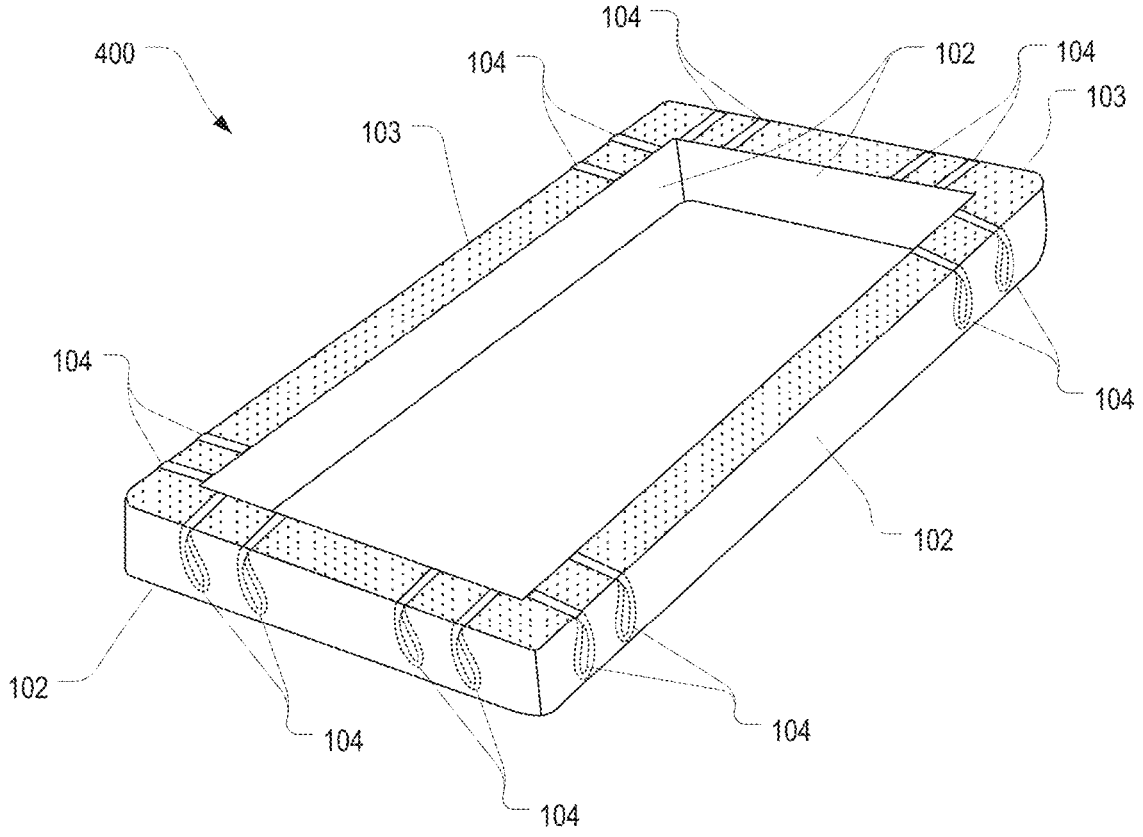
FIG. 4A illustrates a perspective top view of the bed sheet of FIG. 4 with the top portion of the bed sheet removed.

FIG. 4 illustrates another embodiment of a bed sheet 400 that includes handles 104 positioned along the ends of top portion 101. In this embodiment, up to eight medical personnel could each lift bed sheet 400 using a pair of handles 104. As shown in FIG. 4A, which illustrates bed sheet 400 with top portion 101 removed, webbing 103 can extend fully around the periphery of top portion 101 to allow each pair of handles 104 to be secured to webbing 103. Although webbing 103 is shown as a continuous piece of material, multiple pieces of material could be used to form webbing 103. However, if multiple pieces of webbing 103 are employed, it would be preferable to interconnect the multiple pieces to provide a stronger reinforced structure underneath top portion 101.

Figure 5:
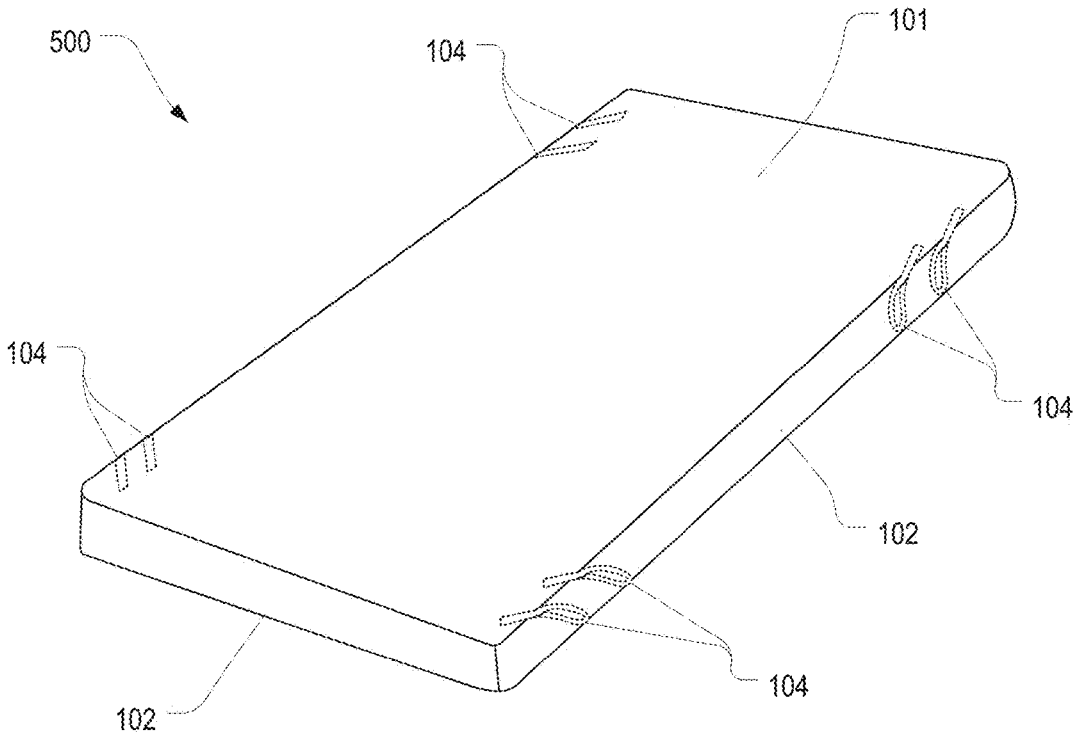
FIG. 5 illustrates a perspective top view of a bed sheet having handles that are attached to the bed sheet at an angle in accordance with one or more embodiments of the present invention.

FIG. 5 illustrates another embodiment of a bed sheet 500 having handles 104. Bed sheet 500 can be configured similar to any of the above-described bed sheets except that handles 104 are secured to top portion 101 at an angle. In other words, when bed sheet 500 is placed on a mattress, handles 104 would be oriented at an angle to the horizontal orientation of top portion 101, as is shown. Orienting handles 104 at an angle can be preferred in embodiments where the height of sidewall 102 is reduced. For example, in some instances a typical hospital mattress has a thickness of approximately 12 inches. A preferred length for the loop portion of handles 104 may be approximately 9 inches, although any other suitable size may be used. Therefore, the loop portion of handles 104 would be fully contained or concealed underneath sidewall 102 in a bed sheet that is configured for a 12 inch mattress. In contrast, if the mattress is less than 9 inches thick, a portion of handles 104 may extend out from sidewall 102. This could result in a handle 104 being caught on a structure during movement of a hospital bed. By angling handles 104, however, the length of the loop portion of handle 104 may be at least as long as the height of sidewall 102 while still retaining the entire handle underneath the sidewall. In particular, because handles 104 may be formed of a somewhat rigid material, the loop portion of handles 104 may remain angled at substantially the same angle as the top portion of handles 104. In other words, the angle at which handles 104 are secured to top portion 101 may prevent the loop portion of handles 104 from hanging straight downward thereby preventing the handles from being exposed outside of sidewall 102.

Figure 5A:
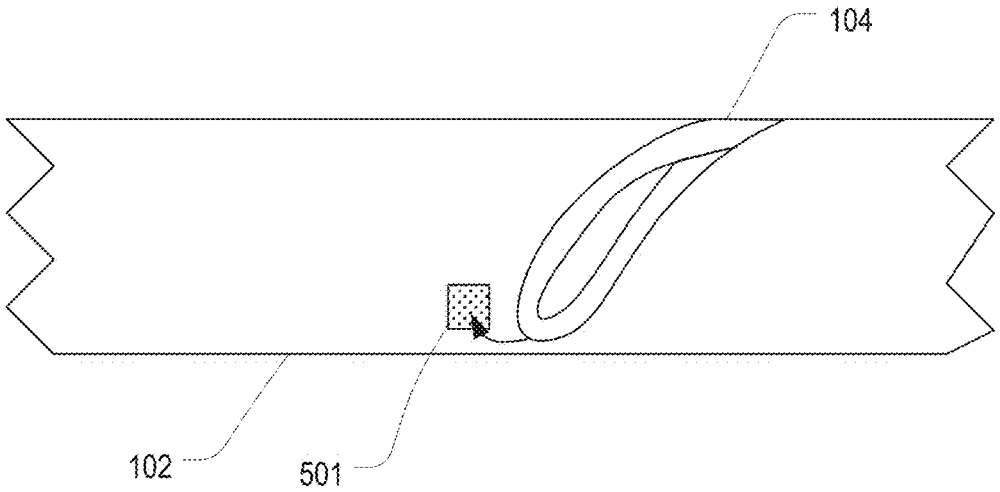
FIG. 5A illustrates how the inside of the sidewall of the bed sheet of FIG. 5 can include a securing structure to secure the handle to the sidewall thereby preventing the handle from extending below the sidewall.

In some embodiments, such as is shown in FIG. 5A, an inside surface of sidewall 102 may include a securing structure 501 to which the loop portion of handle 104 may be secured to further prevent the handle from being exposed outside of sidewall 102. For example, securing structure 501 may comprise a button configuration, a hook and look configuration, a pocket configuration, or any other suitable structure that would secure the loop portion of handle 104 at an angle.

In summary, a bed sheet may include handles that are secured to the top portion of the bed sheet using a webbing. By including a webbing in the structure, the bed sheet can have sufficient strength to allow even heavy patients to be lifted using the bed sheet. Further, the use of loop-shaped handles can allow medical personnel to lift a patient more safely and securely with reduced risk of injury.

Figure 6A:
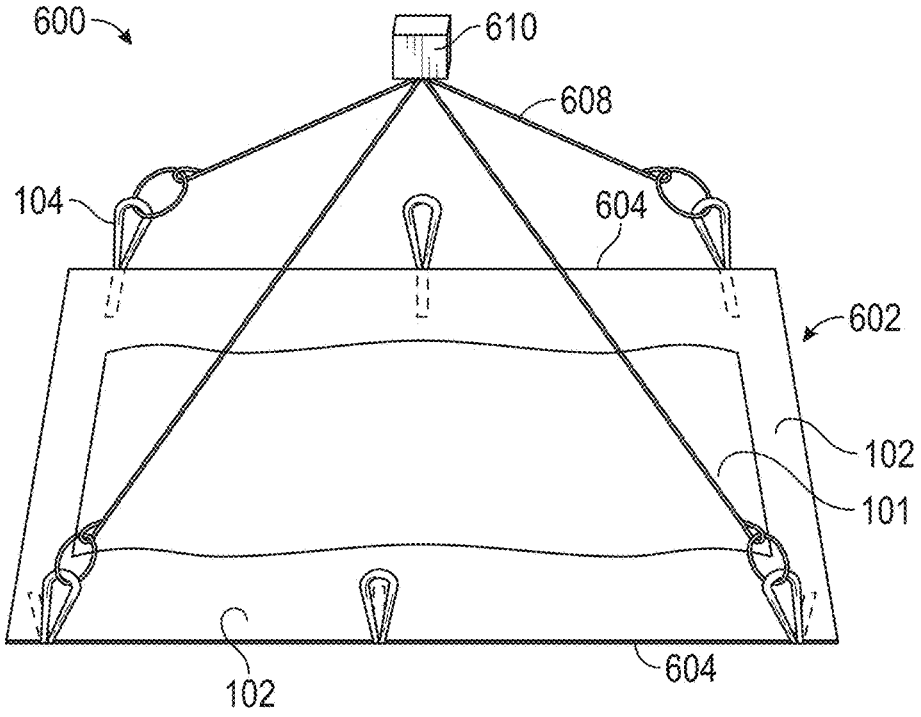
FIG. 6A illustrates a perspective top view of a lift system, in accordance with one or more embodiments of the present invention.

Many hospitals and health care facilities have "zero-lift programs" that prohibit health care workers from manually lifting and transferring patients, in order to reduce injuries. FIG. 6A illustrates an example lift system 600 that allows patients to be transported from a bed to another location, without manual lifting.

As illustrated in FIG. 6A, in some embodiments, the lift system 600 may include a bed sheet 602 having handles 104. In some embodiments, the bed sheet 602 may correspond to the bed sheet 100 of FIG. 1, the bed sheet 200 of FIG. 2, the bed sheet 300 of FIG. 3, the bed sheet 400 of FIG. 4, the bed sheet 500 of FIG. 5, or the bed sheet 700 of FIG. 7. Multiple handles 104 may be positioned on lengthwise edges 604 of the top portion 101 of the bed sheet 102. For example, as illustrated in FIG. 6A, three handles 104 may be positioned on a first lengthwise edge 604 and three handles may be positioned on a second lengthwise edge 604. As illustrated in FIG. 6, in some embodiments, the handles 104 may be positioned proximate one or more corners of the top portion 101 of the bed sheet 602. A number and arrangement of the handles 104 along the lengthwise edges 604 of the bed sheet 602 may vary.

In some embodiments, the lift system 100 may include a hoist configured to raise and lower the bed sheet 602. The hoist may include one or more support straps 608 and/or one or more winches 610. In some embodiments, the support straps 608 may extend downwardly from the one or more winches 610 and may be coupled to the handles 104 of the bed sheet 602. In some embodiments, the support straps 608 may be coupled with the handles 104 by fitting, snapping, threading, connecting, attaching, fastening, clipping, hooking, or any other suitable means of coupling. For example, an end of a particular support strap 608 may include a hook, which may be inserted into a particular handle 104. As another example, the ends of the support straps 608 may include loop portions, which may be coupled with the loop portion of the handles 104 using a carabiner or similar device, as illustrated in FIG. 6A. In some embodiments, the sidewalls 102 may be lifted up away from the sides of the bed and folded back in order to access the handles 104, as illustrated in FIG. 6A.

Figure 6B:
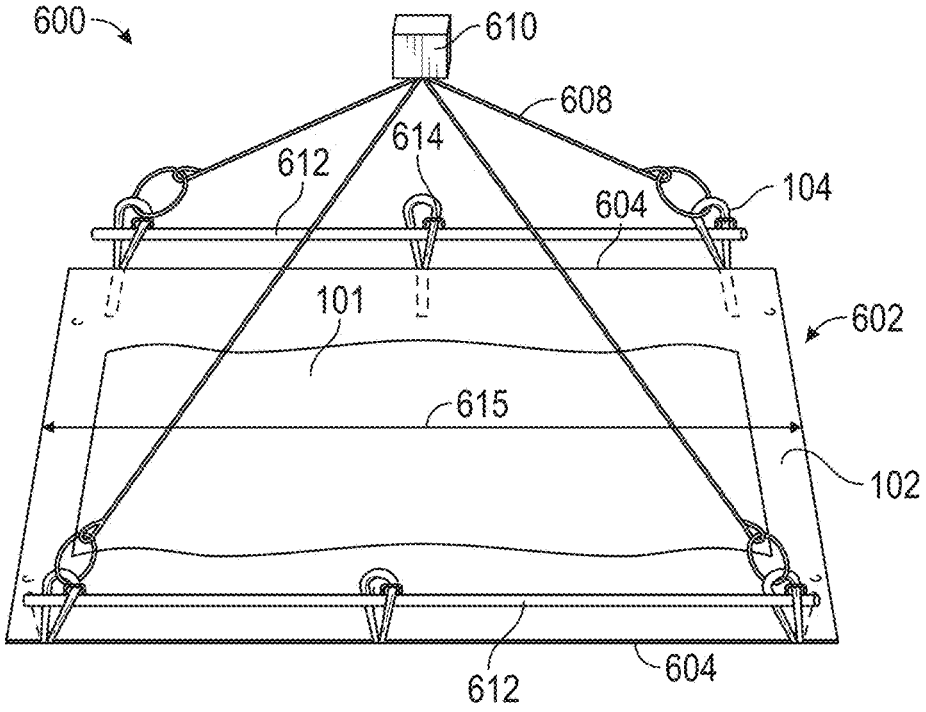
FIG. 6B illustrates a perspective top view of the lift system of FIG. 6A having lengthwise tension rods, in accordance with one or more embodiments of the present invention.

As illustrated in FIG. 6B, in some embodiments, the lift device 600 may include one or more tension rods 612 that may be parallel to the lengthwise edges 604 of the top portion 101 of the bed sheet 602 (referred to herein as "lengthwise tension rods 612"). The lengthwise tension rods 612 may increase rigidity and stability along a length 615 of the top portion 101, which may prevent the bed sheet 602 from or folding lengthwise or forming a "taco shape" such that that encloses the patient when a patient is transported using the lift system 600.

In some embodiments, the lengthwise tension rods 612 may be coupled with the handles 104 by fitting, snapping, threading, connecting, attaching, fastening, clipping, hooking, or any other suitable means of coupling. For example, the lengthwise tension rods 612 may extend through the handles 104. Additionally or alternatively, the lengthwise tension rods 612 may include one or more clips 614 or similar devices configured to clip the handles 104 to the lengthwise tension rods 612, which may prevent the tension rod 612 from sliding within the handles 104. In some embodiments, the support straps 608 may be coupled with the bed sheet 602 via the clips 614 of the lengthwise tension rods 612 in addition to, or instead of, being coupled directly to the handles 104. In some embodiments, the handles 104 may include clips (not shown) or similar devices configured to couple the handles 104 with the support straps 608 and/or the lengthwise tension rods 612.

In some embodiments, a particular lengthwise tension rod 612 may extend through multiple handles 104 positioned on the lengthwise edge 604. In some embodiments, a first lengthwise tension rod 612 may extend through the handles 104 positioned on a first lengthwise edge 604, and a second lengthwise tension rod 612 may extend through the handles 104 positioned on a second lengthwise edge 604. In some embodiments, the first lengthwise tension rod 612 may be parallel to the second lengthwise tension rod 612.

In some embodiments, a length of a particular lengthwise tension rod 612 may be approximately equal to the length 615 of the top portion 101 of the bed sheet 602. In some embodiments, the length of the particular lengthwise tension rod 612 may be less than the length 615 of the top portion 101 of the bed sheet 602.

Figure 6C:
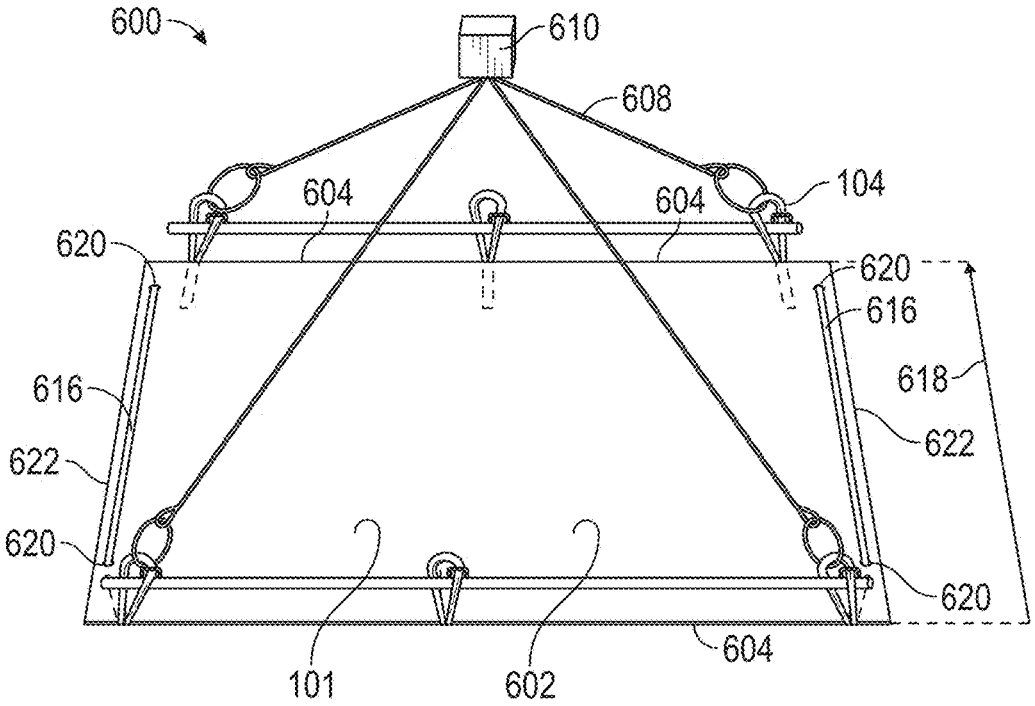
FIG. 6C illustrates a perspective top view of the lift system of FIG. 6A having lengthwise and widthwise tension rods, with the sidewalls of the bed sheet removed, in accordance with one or more embodiments of the present invention.

As illustrated in FIG. 6C, in some embodiments, the lift device may include one or more tension rods 616 that may be perpendicular to the lengthwise edges of the top portion of the bed sheet (referred to herein as "widthwise tension rods 616"). In some embodiments, the widthwise tension rods 616 may extend along at least a portion of a width 618 of the top portion 101. In some embodiments, the widthwise tension rods 616 may be approximately equal to the width 618 of the top portion 101. The widthwise tension rods 616 may increase rigidity and stability along the width 618 of the top portion, which may prevent the bed sheet 602 from folding widthwise or forming a "taco shape" that encloses the patient when a patient is transported using the lift system 600.

In some embodiments, the widthwise tension rods 616 may be coupled with the handles 104 and/or the top portion 101 by fitting, snapping, threading, connecting, attaching, fastening, clipping, hooking, or any other suitable means of coupling. For example, the top portion 101 may include multiple eyelets 620 sized and configured to fit ends of the widthwise tension rods 616. In some embodiments, the eyelets 620 may be disposed proximate corners and/or widthwise edges 622 of the top portion. In some embodiments, a first end of a particular widthwise tension rod 616 may be disposed in a first eyelet 620 of the top portion 101, and a second end of the particular widthwise tension rod 616 may be disposed in a second eyelet 620 of the top portion 101. The first eyelet 620 and the second eyelet 620 may be a same distance from a particular widthwise edge 622 of the top portion 101.

In some embodiments, the lengthwise tension rods 612 and/or the widthwise tension rods 616 may be constructed from metal, wood, plastic, a composite material, combinations thereof, or any other suitable material.

Figure 7:
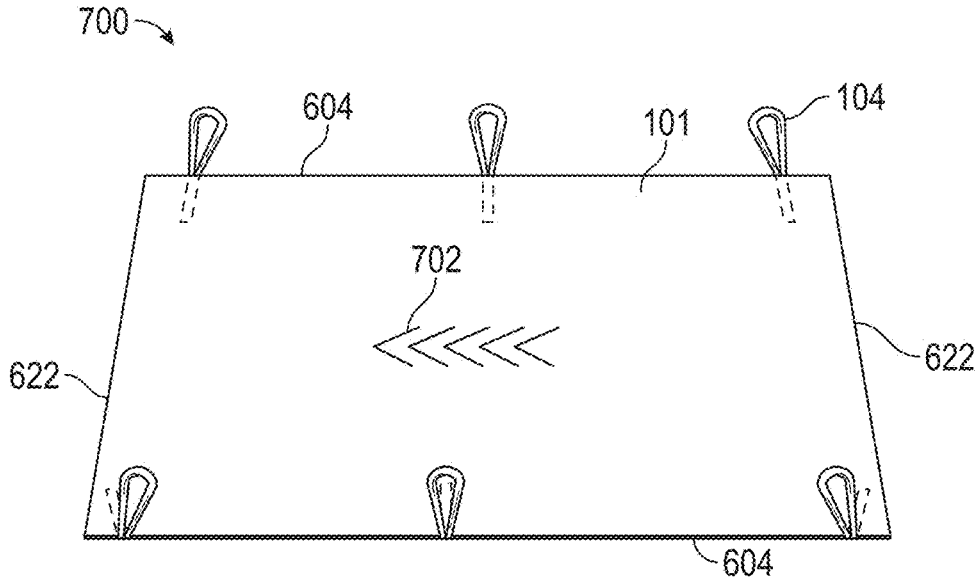
FIG. 7 illustrates a perspective top view of another bed sheet having handles and a grip portion, with the sidewalls of the bed sheet removed, in accordance with one or more embodiments of the present invention.

In some embodiments, the bed sheet 602 may include a trap door configured to open and close, as will be explained later in further detail. As illustrated in FIG. 7, in some embodiments, a central portion of the top portion 101 of the bed sheet 700 may include a grip portion 702 configured to increase friction between a body of the patient and the bed sheet 700 and prevent slipping. In some embodiments, the grip portion 702 may include a woven pattern, such as, for example, a chevron pattern, as illustrated in FIG. 7. In some embodiments, the grip portion 702 may include a grip polymer.

Figure 8A:
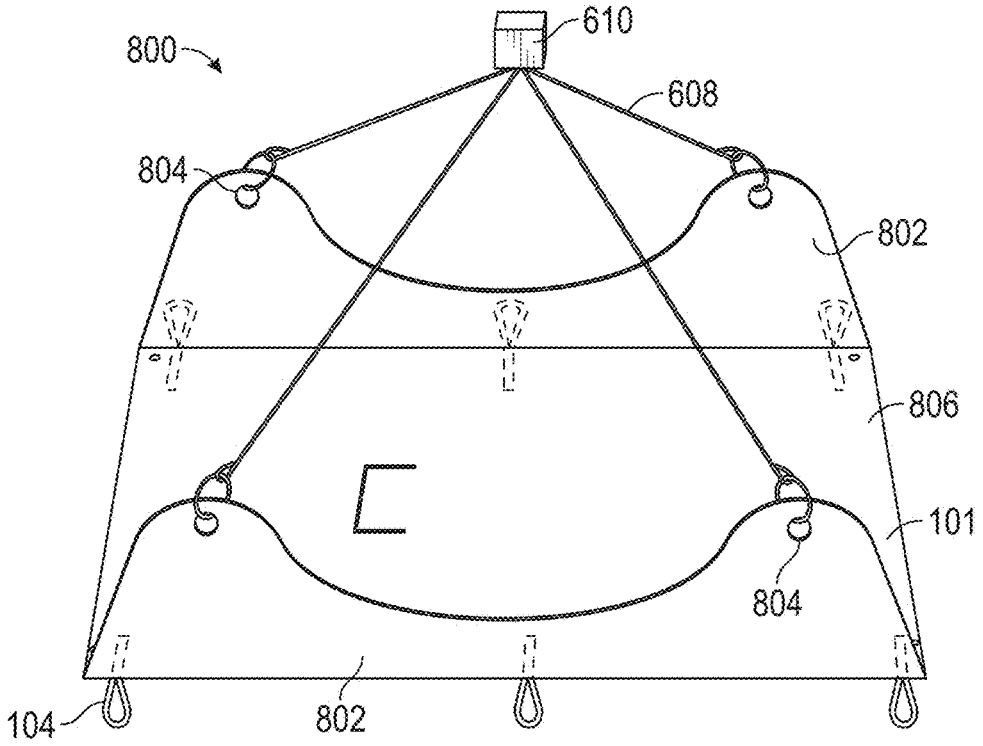
FIG. 8A illustrates a perspective top view of another lift system, in accordance with one or more embodiments of the present invention.

FIG. 8 illustrates another example lift system 800, according to some embodiments. In some embodiments, the lift system 800 may correspond to the lift system 600. In some embodiments, the lift system 800 may include one or more extensions 802 that each extend along at least a portion of a particular lengthwise edge 604. For example, the lift system 800 may include a first extension 802 and a second extension 802 that extend along at least a portion of a first lengthwise edge 604 and a second lengthwise edge 604, respectively. The extensions 802 may be lifted up away from the sides of the bed and coupled with the support straps 608 of the hoist. The extensions 802 may be coupled with the support straps 608 by fitting, snapping, threading, connecting, attaching, fastening, clipping, hooking, or any other suitable means of coupling. In some embodiments, the extensions 802 may include one or more islets 804. In some embodiments, ends of the support straps 608 may include hooks and/or clips, which may be inserted into the islets 804. In some embodiments, the islets 802 may be positioned at upper portions of the extensions 802.

The first and second extensions 802 may be configured to point generally upwardly when coupled with the support straps 608. In some embodiments, where a bed sheet 806 is a flat sheet, the extensions 802 may not be a separate component from the top portion 101. In some embodiments, the extensions 608 may be a separate component from the top portion 101 but may be secured to the top portion 101. In some embodiments, each of the extensions 608 may be generally M-shaped, and the islets 804 may be positioned at upper portions of the M-shape.

Figure 8B:
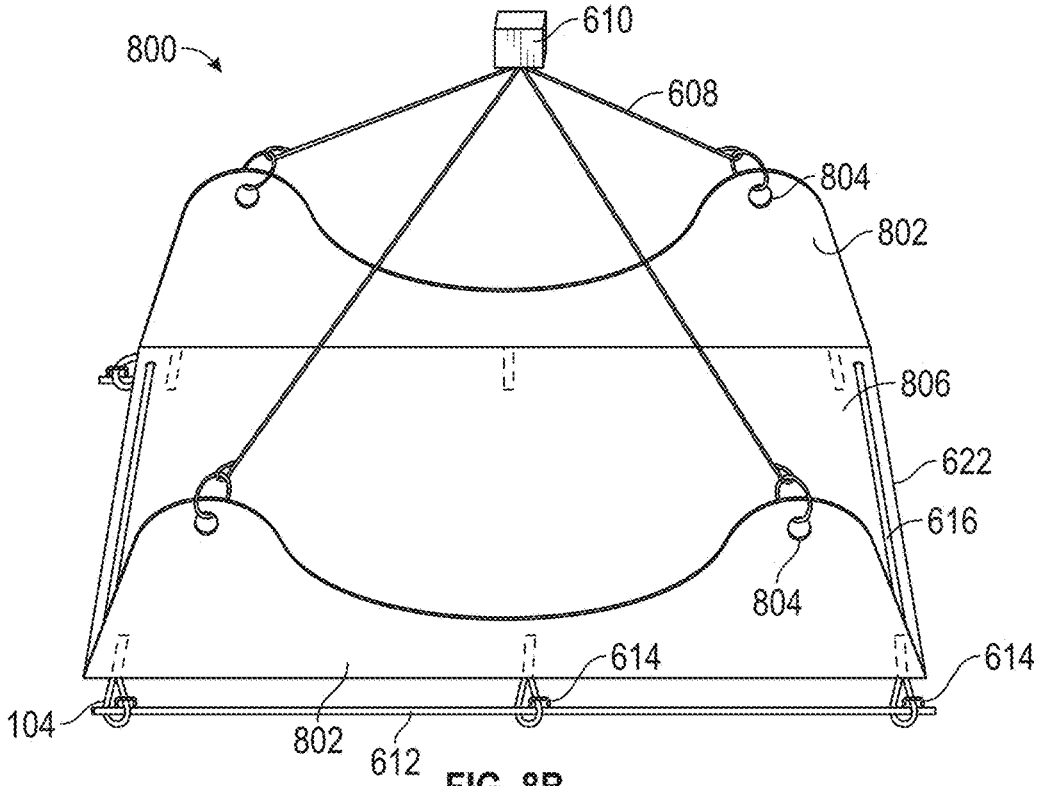
FIG. 8B illustrates a perspective top view of the lift system of FIG. 8A having lengthwise and widthwise tension rods, in accordance with one or more embodiments of the present invention.

As illustrated in FIG. 8B, the lift system 800 may also include one or more lengthwise tension bars 612 and/or one or more widthwise tension bars 616. Similar to the sidewall 102, to expose handles 104 for use, the extensions 802 may be lifted up away from the sides of the bed.

Figure 8C:
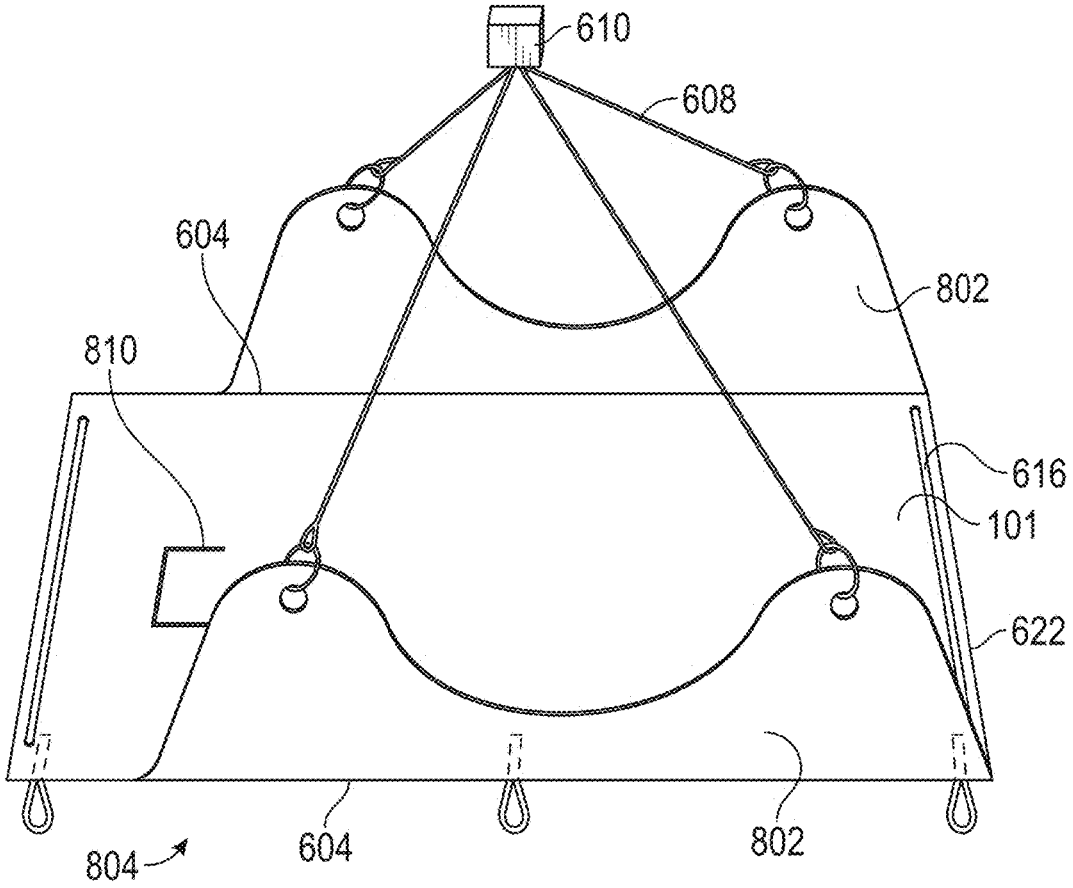
FIG. 8C illustrates a perspective top view of the lift system of FIG. 8A, in accordance with one or more embodiments of the present invention.

As illustrated in FIG. 8C, in some embodiments, the first extension 802 may extend along a first portion of a first lengthwise edge 604 of the top portion 101, and the second extension may extend along a first portion of the second lengthwise edge 604 of the top portion 101. In some embodiments, a second portion of the first lengthwise edge 604 and a second portion of the second lengthwise edge 604 may be perpendicular to the first portion of the first lengthwise edge 604 and the first portion of the second lengthwise edge 604, respectively. In some embodiments, a length of the first portion of the first lengthwise edge 604 may be approximately equal to a length of the first portion of the second lengthwise edge 604. In further detail, as illustrated in FIG. 8C, a portion of the top portion 101 between the second portion of the first lengthwise edge 604 and a second portion of the second lengthwise edge 604 may fold downwardly 808 when the lengthwise tension bars 616 are removed or moved away from the second portion of the first lengthwise edge 604 and the second portion of the second lengthwise edge 604. Thus, when the patient is lifted off the bed by the lift system 800, the bed sheet may be configured to form a chair and the patients legs may be positioned vertically.

In some embodiments, a trap door 810 may be disposed in the top portion proximate a seat of the chair. The trap door 810 may be configured to open and close via a zipper, snap, etc. The trap door 810 may be opened and placed over top of a toilet, for example.

Figure 9:
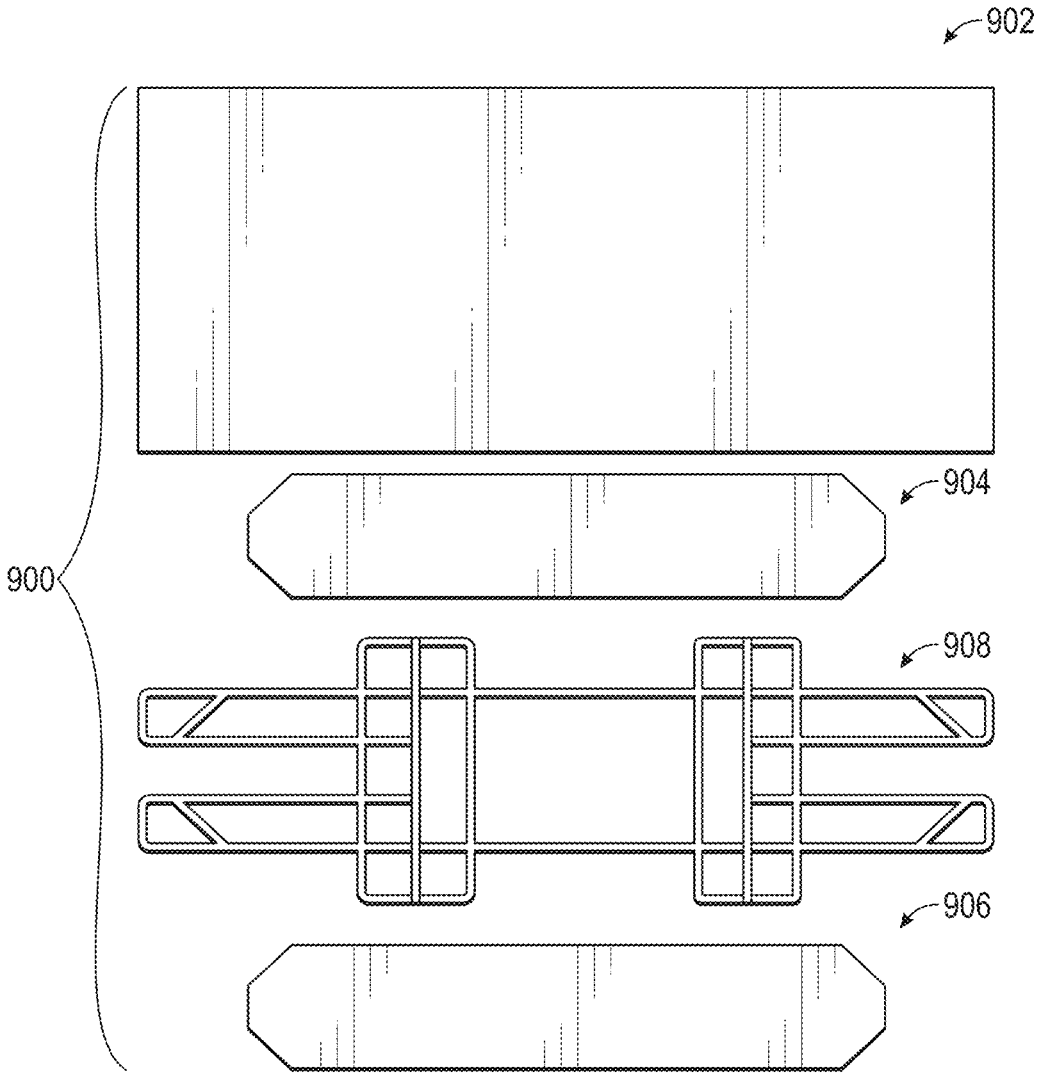
FIG. 9 is an exploded view of another example bed sheet, in accordance with one or more embodiments of the present invention.

Referring now to FIG. 9, in some embodiments, a bed sheet 900 may be configured for use with both a first bed and a second bed. In some embodiments, the first bed may include a gurney. In some embodiments, the second bed may include any bed larger than the first bed, such as, for example, a hospital bed, etc. In some embodiments, the bed sheet 900 may be configured to facilitate carrying or transfer of the patient from the first bed to the second bed and/or may be used with both the first and second beds without having to remove the patient from the bed sheet 900. In some embodiments, a particular bed sheet lift system may include only the bed sheet 900, which the medical personnel may lift to transport the patient.

In some embodiments, the bed sheet 900 may include or correspond to any of the bed sheets illustrated in any of FIGS. 1-8, including the bed sheet 100, the bed sheet 400, the bed sheet 602, the bed sheet 700, and the bed sheet 806. In some embodiments, the bed sheet 900 may be configured to be used with a hoist or other mechanical lifting system.

Figure 10:
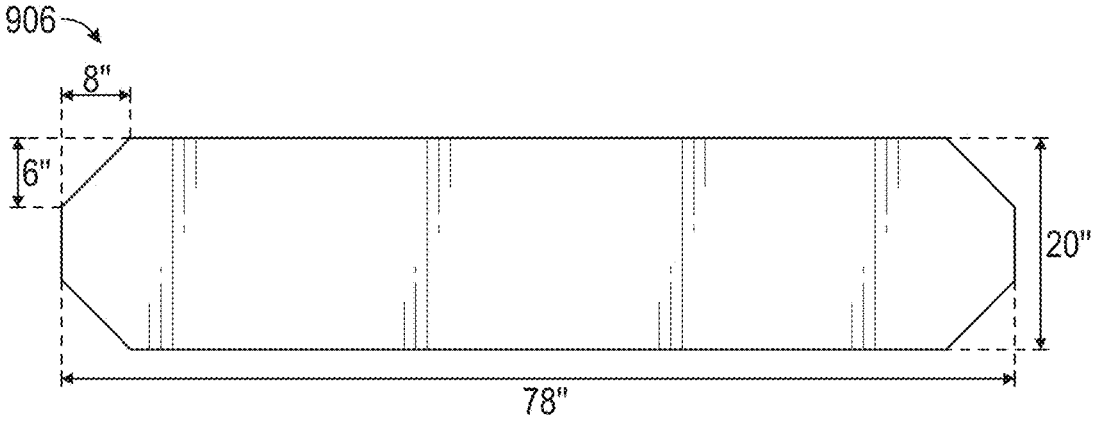
FIG. 10 illustrates an example third sheet of the bed sheet of FIG. 9, in accordance with one or more embodiments of the present invention.

In some embodiments, the bed sheet 900 may include one or more of the following components: a first sheet 902, a second sheet 904, a third sheet 906, and a support structure 908. Referring now to FIG. 10, in some embodiments, the third sheet 906 may be sized and configured to cover an upper surface of the first bed. For example, a size of the third sheet 906 may be approximately equal to a size of an upper surface of a gurney. In some embodiments, edges of the third sheet 906 may be aligned with edges of the first bed when the third sheet 906 lays flat across the first bed. The third sheet 906 may have various dimensions. In some embodiments, a length of the third sheet 906 may be about 78 inches. In some embodiments, a width of the third sheet 906 may be about 20 inches. In some embodiments, the third sheet 906 may be hemmed or cut along a diagonal, which may, for example, have a height of about 6 inches and a length of about 8 inches. In some embodiments, the second sheet 904 may be sized and configured equal or similar to the third sheet 906.

Figure 11:
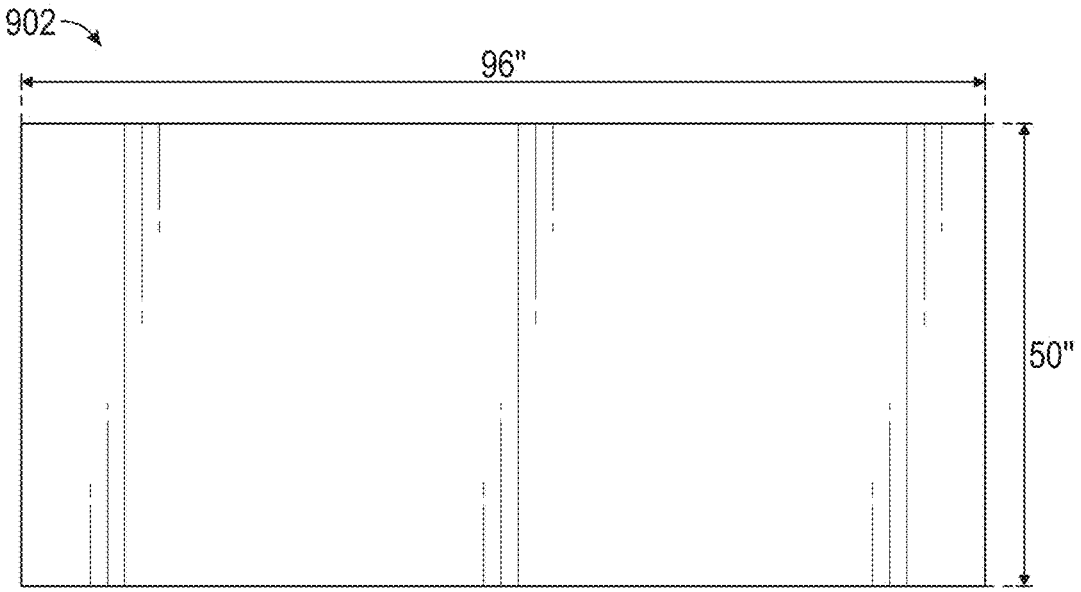
FIG. 11 illustrates an example first sheet of the bed sheet of FIG. 9, in accordance with one or more embodiments of the present invention.

Referring now to FIG. 11, in some embodiments, the first sheet 902 may be larger than the second and/or third sheets 904 and 906. In some embodiments, when the bed sheet 900 is placed on the first bed with the third sheet 906 on top or facing upward and/or the first sheet 902 on bottom or facing downward, the second sheet 904 and/or the third sheet 906 may be aligned with or approximately cover the upper surface of the first bed, and the first sheet 902 may extend or hang over sides of the first bed. In these and other embodiments, edges of the first sheet 902 may be secured underneath the first bed. For example, the edges of the first sheet 902 may be tucked underneath the first bed. The first sheet 902 may have various dimensions. In some embodiments, the first sheet 902 may have a length of about 96 inches and a width of about 50 inches, which may facilitate securing underneath the first bed and cover the second bed.

In some embodiments, when the bed sheet 900 is placed on the second bed, the second sheet 904 and/or the third sheet 906 may be smaller than an upper surface of the second bed, and a size of the first sheet 902 may allow the upper surface of the second bed to be covered. In some embodiments, the bed sheet 900 may be placed on the second bed with the third sheet 906 on the bottom or facing downward. Alternatively, in some embodiments, the bed sheet 900 may be placed on the second bed with the third sheet 906 on the top or facing upward and/or the first sheet 902 on the bottom or facing downward, which may allow transfer of the patient from the first bed to the second bed without removal of the patient from the bed sheet 900.

Figure 12:
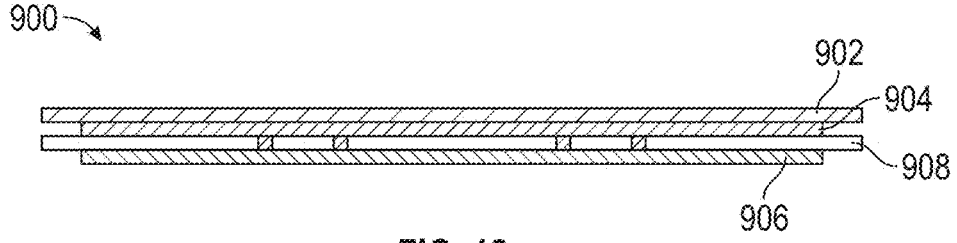
FIG. 12 illustrates a lengthwise cross-sectional view of the bed sheet of FIG. 9, in accordance with one or more embodiments of the present invention.

Referring now to FIG. 12, in some embodiments, the bed sheet 900 may be layered in the following order: the first sheet 902, the second sheet 904, the support structure 908, and the third sheet 906.

Figure 13:
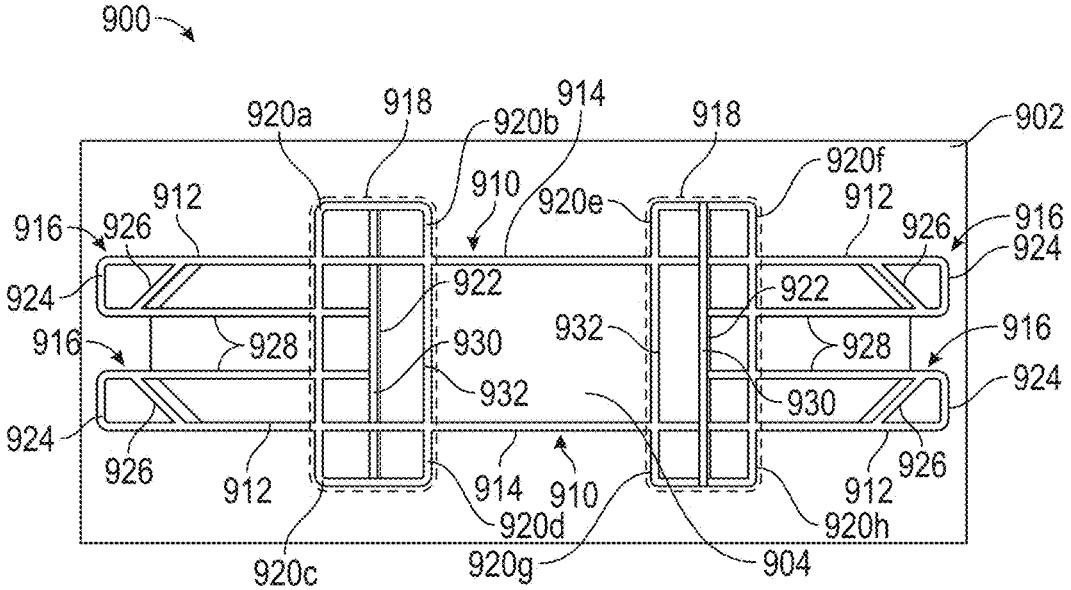
FIG. 13 is a bottom view of the bed sheet of FIG. 9 with the third portion removed, in accordance with one or more embodiments of the present invention.
Figure 14:
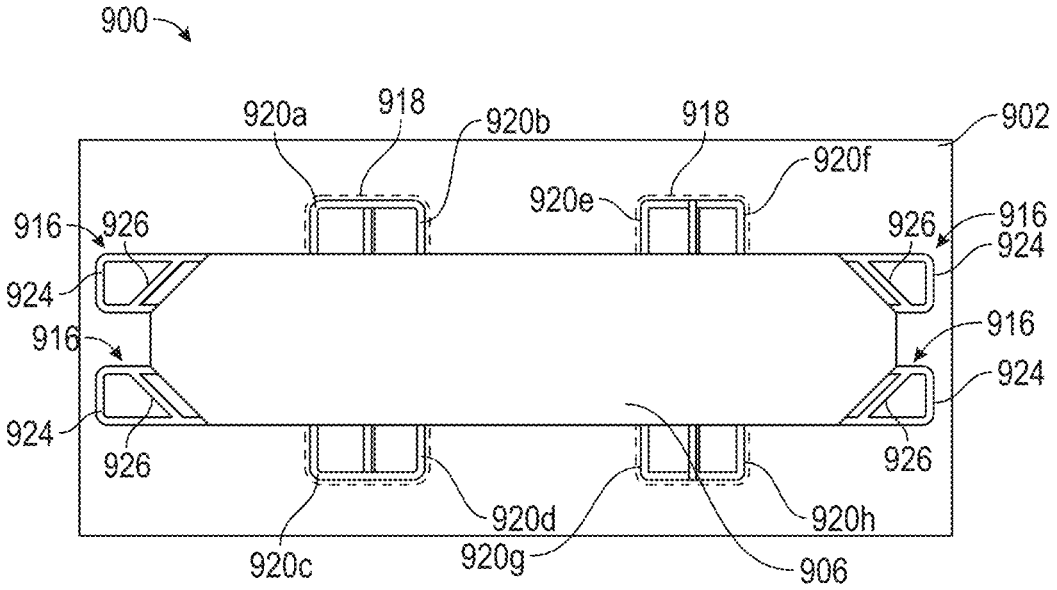
FIG. 14 is a bottom view of the bed sheet of FIG. 9, in accordance with one or more embodiments of the present invention.

Referring now to FIG. 13, in some embodiments, one or more of the following: the first sheet 902, the second sheet 904, the third sheet 906, and the support structure 908, may be coupled together via any suitable means of coupling, such as, for example, sewing, stitching, fasteners, adhesive, Velcro®, etc. In some embodiments, sewing may provide strength that facilitates transport of the patient without tearing or separation of the bed sheet 900. In some embodiments, coupling may include direct coupling, which may include, for example, sewing one component of the bed sheet 900 to another component of the bed sheet 900 or another means of direct coupling.

In some embodiments, the support structure 908 may be coupled with one or more of the following: the first sheet 902, the second sheet 904, and the third sheet 906. In some embodiments, the support structure 908 may be coupled with the second sheet 904 and/or the third sheet 906. In some embodiments, the second sheet 904 and the third sheet 906 may be coupled together for strength and/or the second sheet 904 and the third sheet 906 may then be coupled to the first sheet 902. In some embodiments, edges of the second sheet 904 may be coupled with edges of the third sheet 906.

In some embodiments, the support structure 908 may include at least two longitudinal portions 910 that extend along lengthwise, outer edges of the second sheet 904 and/or the third sheet 906. In some embodiments, each of the longitudinal portions 910 may include ends 912 and a central portion 914. In some embodiments, the longitudinal portions 910 may be generally straight. In some embodiments, the longitudinal portions 910 may create a taut or tight edge to prevent the patient from rolling out of the bed sheet 900 when the patient is being transported in the bed sheet 900. In some embodiments, the support structure 908 may include multiple V-shaped or U-shaped portions 916, which may be disposed proximate the longitudinal portions 910. In some embodiments, each of the U-shaped portions 916 may extend beyond a length of the second sheet 904 and/or the third sheet 906.

In some embodiments, the support structure 908 may include one or more looped portions 918, which may extend perpendicularly to the U-shaped portions 916 and/or the longitudinal portions 910. In some embodiments, the looped portions 918 may extend across a width of the second sheet 904 and/or the third sheet 906. Each of the looped portions 918 may include one or more handles **920*a*-920*h* (which may be referred to hereinafter as "handles 920"). In some embodiments, each of the looped portions 918 may include one or more divider portions 922 the may extend along a length of the looped portion 918 and divide the looped portion 918 to form multiple handles 920. In some embodiments, the handles 920 of the looped portion 918 may be disposed between the lengthwise edge of the second sheet 904 and a lengthwise edge of the first sheet 902, as illustrated in FIG. 13. In some embodiments, the looped portions 918 may include one or more outer handles and/or one or more inner handles, similar to the U-shaped portion 916. In some embodiments, the multiple handles 920 may facilitate easy transfer of the bed sheet 900** from one medical personnel to another when transporting the patient.

In some embodiments, the U-shaped portions 916 may each include one or more outer handles 924 and/or one or more inner handles 926. In some embodiments, the U-shaped portions 916 may each include a single outer handle 924 and a single inner handle 926. In some embodiments, compared to the outer handle 924 of a particular U-shaped portion 916, the inner handle 926 of the particular U-shaped portion 916 may be disposed inwardly with respect to the bed sheet 900. In some embodiments, the outer handle 924 of the particular U-shaped portion 916 may be aligned with or just inwardly from a widthwise edge of the first sheet 902.

The outer handles 924 and the inner handles 926 may allow the medical personnel transporting the patient on the bed sheet 900 to use the outer handles 924 or the inner handles 926 depending, for example, on a size of a space through which they are transporting the patient and may prevent injury of the medical personnel. In some embodiments, one or more of the outer handles 924 and/or the inner handles 926 may be angled, which may prevent physical discomfort of the medical personnel transporting the patient and may improve efficiency. The multiple outer handles 924 and/or the inner handles 926 may facilitate easy transfer of the bed sheet 900 from one medical personnel to another when transporting the patient.

In some embodiments, the bed sheet 900 may include two looped portions 918 and eight handles 920 of the looped portions 918. In these and other embodiments, the bed sheet 900 may include four U-shaped portions 916, four outer handles 924, and four inner handles 926. Positioning and/or spacing of the handles of the looped portions 918 and the outer and inner handles 924, 926 of the U-shaped portion 916 may facilitate support of the patient during transfer on the bed sheet 900 as well as favorable arm and body positioning of the medical personnel.

In some embodiments, inner edges 928 of the U-shaped portions 916, disposed towards a middle of the bed sheet 900, may extend parallel to the longitudinal portions 910. In some embodiments, each of the inner edges 928 of the U-shaped portions 916 may terminate at the divider portion 922 of a particular looped portion 918. In some embodiments, a support element 930 may be coupled with the divider portion 922 along an entire length or a portion of the entire length of the divider portion 922. In some embodiments, the support element 930 may include a strap or a strip of flexible material.

In some embodiments, the divider portion 922 and/or the support element 930 may be coupled with each of the first sheet 902, the second sheet 904, and the third sheet 906 along a length of the divider portion 922 and/or the support element 930 that overlaps with the first sheet 902, the second sheet 904, and the third sheet 906. For example, the divider portion and/or the support element may be sewn or stitched to each of the first sheet 902, the second sheet 904, and the third sheet 906 along the length of the divider portion and/or the support element that overlaps with the first sheet 902, the second sheet 904, and the third sheet 906. In some embodiments, the handles 920 of the looped portions 918 and/or portions of the divider portion 922 and/or the support element 930 that do not overlap with the second sheet 904 and/or the third sheet 906 may not be coupled with other components of the bed sheet 900 and may be movable with respect to the other components of the bed sheet 900, which may enable a hand to reach in and grip a particular handle 920.

Similarly, in some embodiments, the outer and inner handles 922, 924 of the U-shaped portion 916 may not be coupled with other components of the bed sheet 900 and may be movable with respect to the other components of the bed sheet 900, which may enable a hand to reach in and grip a particular outer or inner handle.

In some embodiments, the ends 912 of the longitudinal portions 910 disposed between the U-shaped portion 916 and the divider portion 922 may be coupled with each of the first sheet 902, the second sheet 904, and the third sheet 906. In these and other embodiments, all components of the bed sheet 900 may not be coupled together along the central portions 914 of the longitudinal portions 910, disposed between the ends 912 of the longitudinal portions 910. In some embodiments, the inner edge 928 of the each of the U-shaped portion 916 may be coupled with each of the first sheet 902, the second sheet 904, and the third sheet 906. In some embodiments, all or a portion of an inner edge 932 of each of the looped portions 918 may be coupled with each of the first sheet 902, the second sheet 904, and the third sheet 906. In some embodiments, the portion of the inner edge 932 may extend, for example, 2 inches.

In some embodiments, the looped portions 918 may intersect with the U-shaped portions 916 and/or the longitudinal portions 910. In some embodiments, the support structure 908 may be a unitary structure. For example, the U-shaped portion 916, the longitudinal portions 910, the looped portions 918 may be part of a unitary structure. In some embodiments, the support structure 908 may include various separate components which may be coupled together to form the integrated support structure 908. For example, one or more of the U-shaped portions 916, the longitudinal portions 910, and the looped portions 918 may be sewn together to form the support structure 908. In some instances, support structure 908 comprises a singular, monolithic structure, such as may be formed by extrusion, molding, or casting.

In some embodiments, the first sheet 902, the second sheet 904, the third sheet 906, and the support structure 908 may be constructed of any material or combination of materials suitable to provide strength to support the patient on the bed sheet 900. For example, in some embodiments, the second sheet 904 may be constructed of a non-woven material and/or the third sheet 906 may be constructed of a woven material and/or microfiber. In some embodiments, the first sheet 902 may be constructed of a woven material and/or microfiber. In some embodiments, one or more of the following may be constructed of polyester, polypropylene, and the like: the first sheet 902, the second sheet 904, the third sheet 906, and the support structure 908. In some embodiments, one or more of the following may include or correspond to the webbing 103 or the netting 301, illustrated, for example, in FIGS. 1-3: the first sheet 902, the second sheet 904, and the third sheet 906. In some embodiments, the support structure 908 may include rubber. In some embodiments, the support structure 908 may include a strap, rope, webbing, weaving, or the like.

In some embodiments, one or more of the following may be biodegradable and/or recyclable: the first sheet 902, the second sheet 904, the third sheet 906, and the support structure 908. In some embodiments, at least some of the components of the bed sheet 900 may be formed of lyocell (which is the generic term for Tencel®) or other similar biodegradable material. In some embodiments, the materials of the bed sheet 900 may be selected to provide a single-use bed sheet. In other embodiments, the materials of the bed sheet 900 may be selected to provide a reusable bed sheet. In some embodiments, the bed sheet 900 may support over 1000 pounds. In some embodiments, the support structure 908 may support over 4000 pounds.

The bed sheet 900 may include modifications, variations, and/or additions. For example, in some embodiments, the second sheet 904 and/or the third sheet 906 may be removed. In these and other embodiments, the support structure 908 may be coupled directly to the first sheet 902. As another example, in some embodiments, the divider portion may be removed.

Figure 15A:
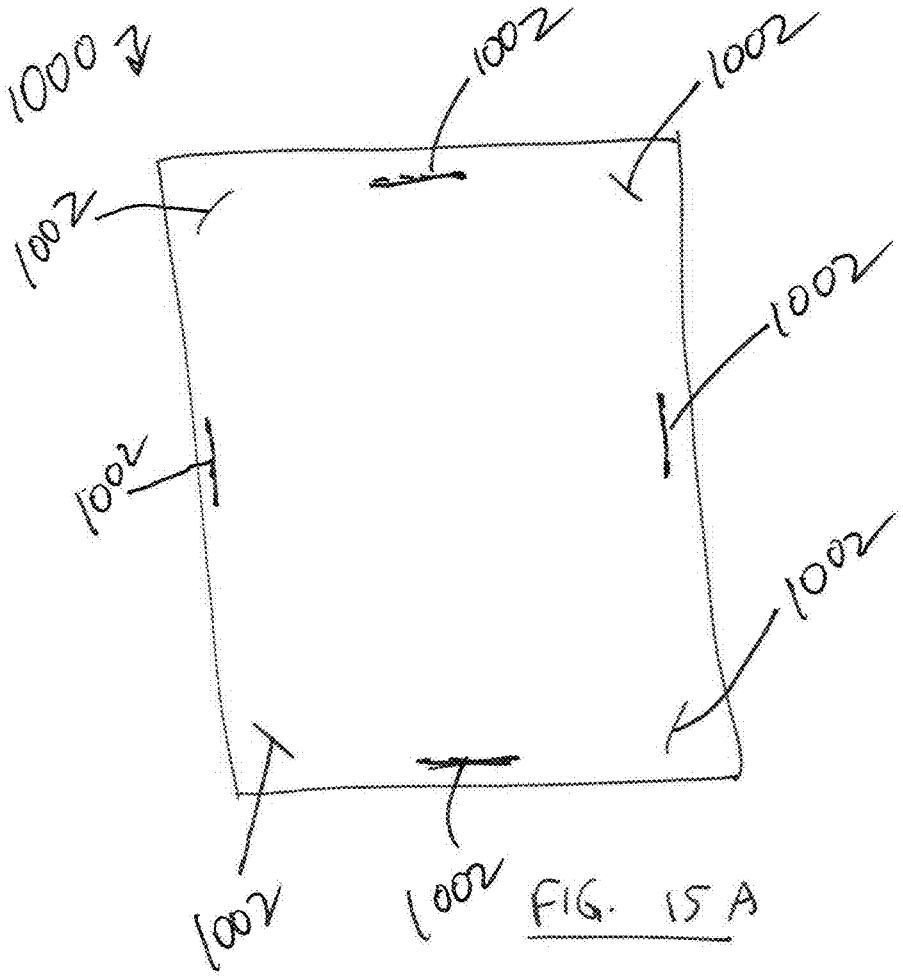
FIG. 15A is a top view of another example bed sheet, in accordance with one or more embodiments of the present invention.
Figure 15B:
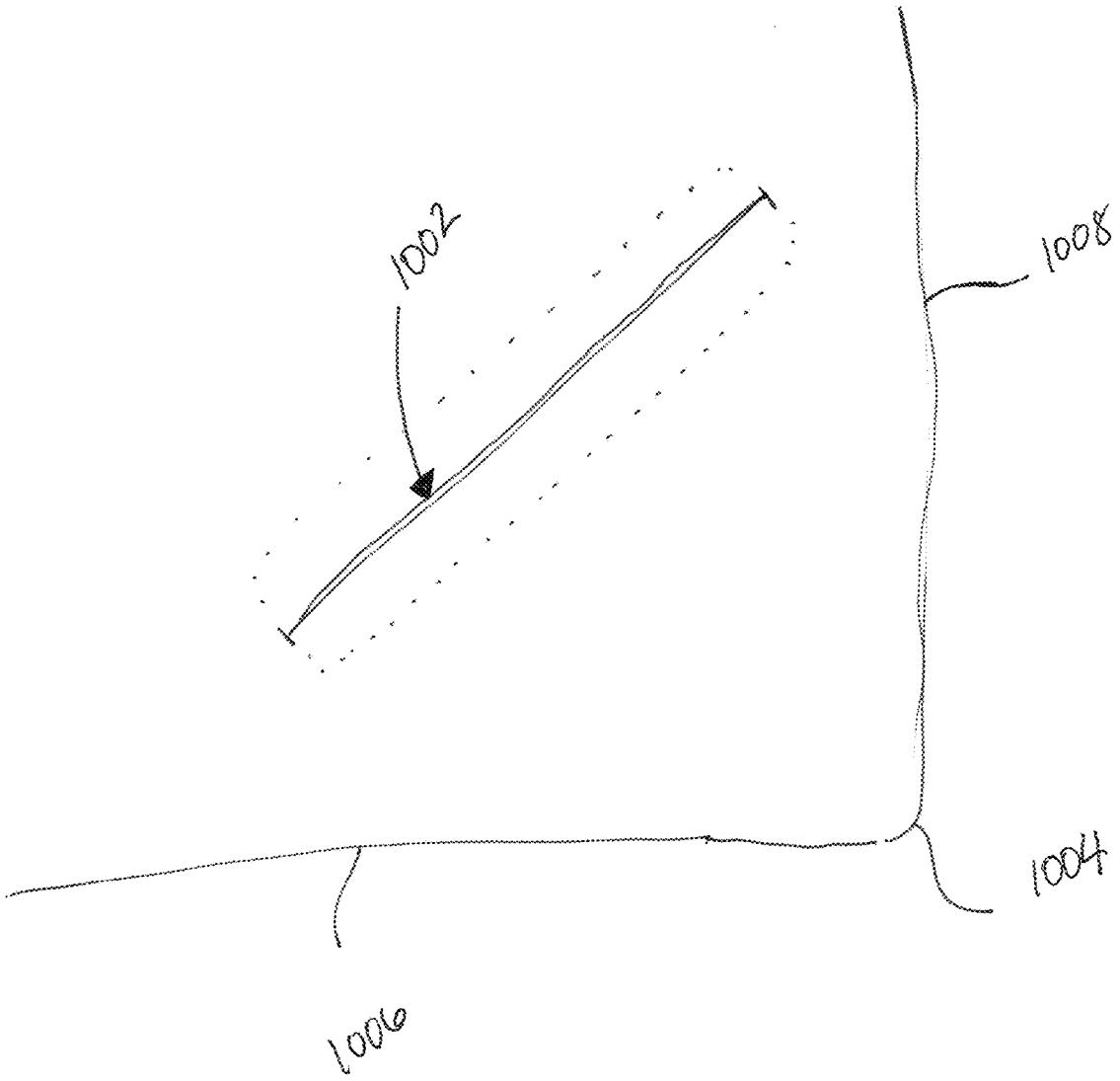
FIG. 15B is top view of a portion of the bed sheet of FIG. 15A, in accordance with one or more embodiments of the present invention.
Figure 15C:
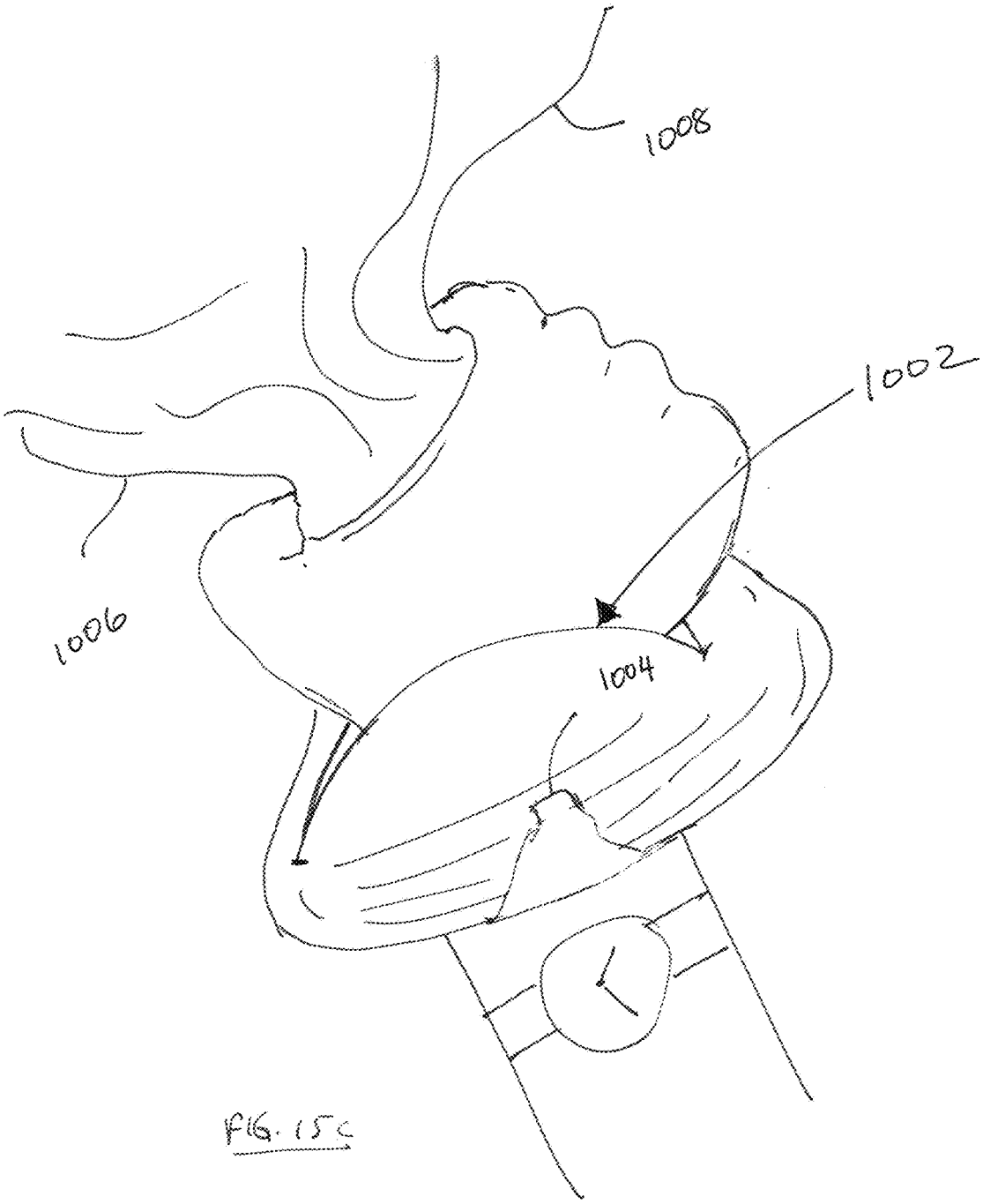
FIG. 15C is an upper perspective view illustrating a wrist of a user extending through an example opening of the bed sheet of FIG. 15A, in accordance with one or more embodiments of the present invention.

Referring now to FIG. 15A-15C, in some embodiments, a bed sheet 1000 may include one or more openings or slits 1002. In some embodiments, the slits 1002 may extend through the bed sheet 1000, which may be a single layer capable of supporting weight of the patient or may include multiple layers or components. In some embodiments, the user or medical personnel may extend his wrist through the slit 1002 and/or grasp a portion of the bed sheet 1000, wherein a portion or surface area of the bed sheet 1000 is supported on a back portion of the user's hand and/or wrist, as illustrated in FIG. 15C, for example. In one embodiment, a user partially inserts their hand through slit 1002 and grasps an edge of the slit 1002 and a portion of the bed sheet 1000 in their hand.

The bed sheet 1000 may include any number of the slits 1002. For example, the bed sheet 1000 may include between one and eight slits 1002. In one embodiment, bed sheet 1000 includes more than eight slits 1002. Positioning of the slits 1002 may also vary. In some embodiments, each of the slits 1002 may be positioned proximate an edge of the bed sheet 1000. In some embodiments, a particular slit 1002 may extend diagonally with respect to a corner 1004, which may be formed by two edges 1006, 1008. In some embodiments, each of the slits 1002 may be reinforced or strengthened along at least a portion of a length of the corresponding slit 1002 through any number of means such as, for example, sewing, stitching, support elements, webbing, etc. In some embodiments, the bed sheet 1000 may include or correspond to any of the bed sheets illustrated in any of FIGS. 1-14, including the bed sheet 100, the bed sheet 400, the bed sheet 602, the bed sheet 700, the bed sheet 806, and the bed sheet 900. In some embodiments, the bed sheet 1000 may include or correspond to the first sheet 902, the second sheet 904, or the third sheet 906.

Figure 16A:
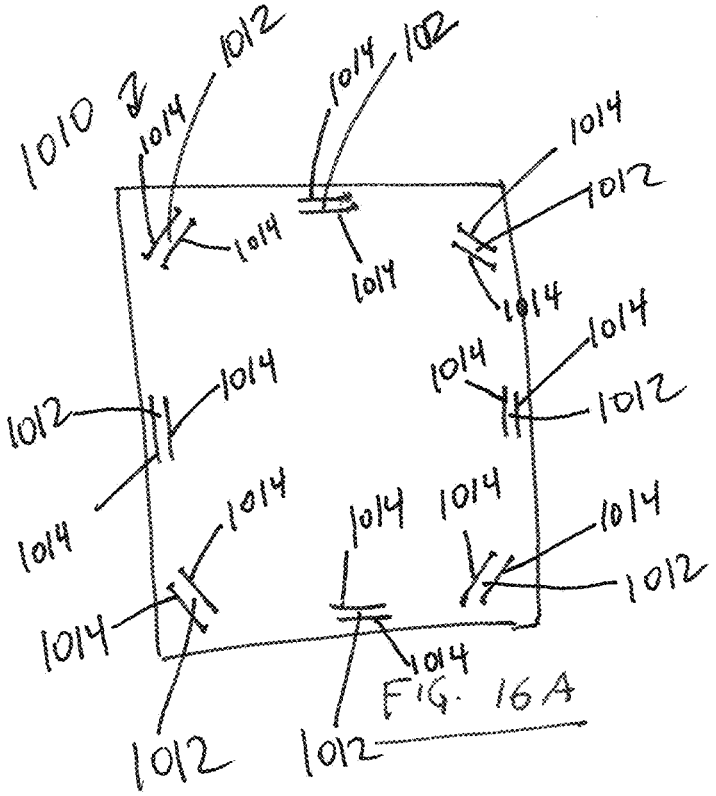
FIG. 16A is a top view of another example bed sheet, in accordance with one or more embodiments of the present invention.
Figure 16B:
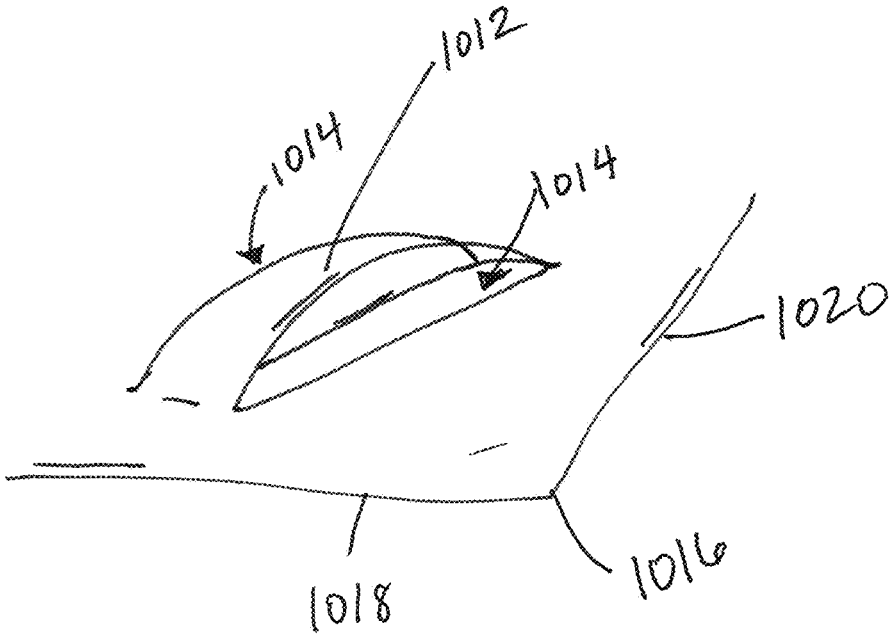
FIG. 16B is an upper perspective view of an example handle of the bed sheet of FIG. 16A, in accordance with one or more embodiments of the present invention.
Figure 16C:
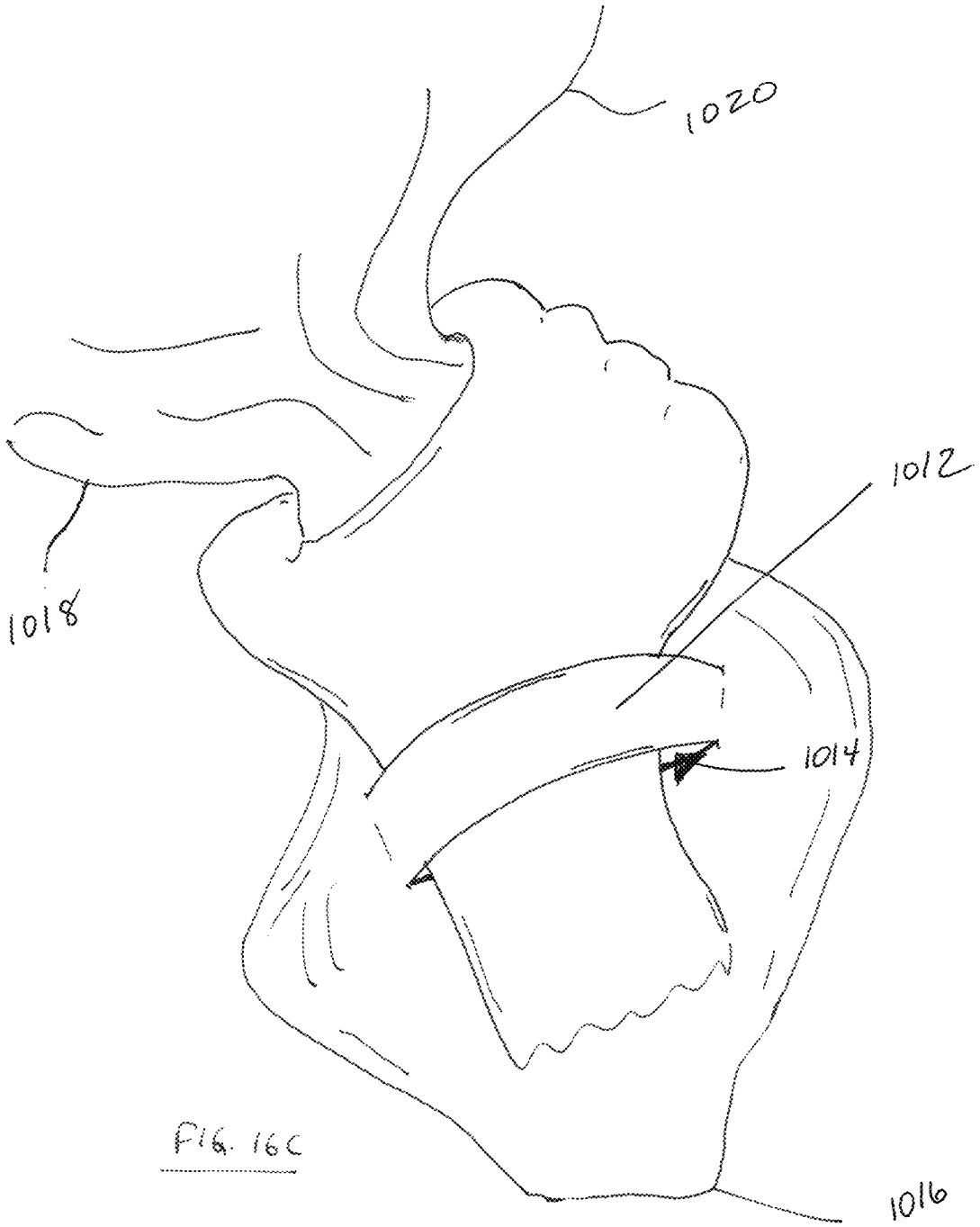
FIG. 16C is an upper perspective view illustrating a wrist of a user extending through the handle of the bed sheet of FIG. 16A.

Referring now to FIGS. 16A-16C, in some embodiments, a bed sheet 1010 may include one or more integrated straps 1012, which may be formed by two slits 1014 in the bed sheet 1010. In some embodiments, the two slits 1014 may be parallel and/or have a similar length. In some embodiments, the slits 1014 may extend through the bed sheet 1010, which may be a single layer or may include multiple layers or components. In some embodiments, the user or medical personnel may extend his wrist through the strap 1012 and/or grasp a portion of the bed sheet 1010, wherein a portion or surface area of the strap 1012 is supported on a back portion of the user's hand and/or wrist, as illustrated in FIG. 16C, for example. In one embodiment, a user grasps the strap 1012 in their hand.

The bed sheet 1010 may include any number of the straps 1012. For example, the bed sheet 1010 may include between one and eight straps 1012. In one embodiment, bed sheet 1010 includes more than eight straps 1012. Positioning of the straps 1012 may also vary. In some embodiments, each of the straps 1012 may be positioned proximate an edge of the bed sheet 1010. In some embodiments, a particular strap 1012 may extend diagonally with respect to a corner 1016 of the bed sheet 1010, which may be formed by two edges 1018, 1020. In some embodiments, each of the straps 1012 may be reinforced or strengthened along at least a portion of a length of the corresponding strap 1012 through any number of means such as, for example, sewing, stitching, support elements, webbing, etc. In some embodiments, the bed sheet 1010 may include or correspond to any of the bed sheets illustrated in any of FIGS. 1-15, including the bed sheet 100, the bed sheet 400, the bed sheet 602, the bed sheet 700, the bed sheet 806, and the bed sheet 900. In some embodiments, the bed sheet 1010 may include or correspond to the first sheet 902, the second sheet 904, or the third sheet 906.

Figure 17A:
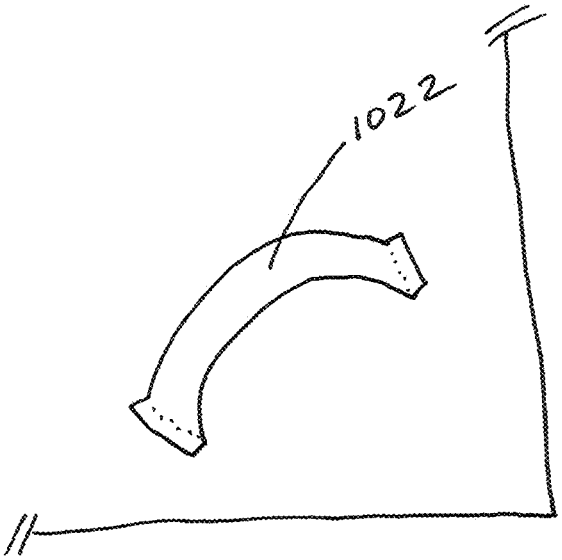
FIG. 17A is a top view of another example handle, in accordance with one or more embodiments of the present invention.
Figure 17B:
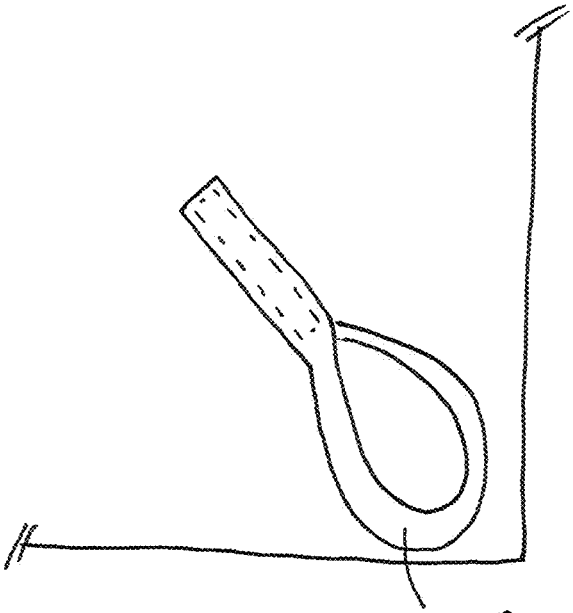
FIG. 17B is a top view of another example handle, in accordance with one or more embodiments of the present invention.

Referring now to FIG. 17, in some embodiments a bed sheet may include a non-integrated handle 1022, which may be coupled with the bed sheet via any suitable means of coupling, such as, for example, sewing, stitching, fasteners, etc. In some embodiments, the handle 1022 may be coupled with a top portion of the bed sheet. In some embodiments, the bed sheet may be a single layer or may include multiple layers or components. In one embodiment, handle 1022 is coupled to the bed sheet via stitching, wherein the portion of the bed sheet to which handle 1022 is coupled further comprises a reinforcing fabric or material that backs the portion of the bed sheet opposite the handle 1022 to provide additional support to the stitching of the handle 1022. In some embodiments, the user or medical personnel may extend his wrist through handle 1022 and/or grasp a portion of the bed sheet. In one embodiment, a user grasps the handle 1022 in their hand. In some embodiments, the handle 1022 may include a looped portion, as illustrated in FIG. 17B.

A number of the handles 1022 may vary. Positioning of the handles 1022 may also vary. In some embodiments, each of the handles 1022 may be positioned proximate an edge of the bed sheet. In some embodiments, a particular handle 1022 may extend diagonally with respect with a corner of the bed sheet. In some embodiments, each of the handles 1022 may be reinforced or strengthened along at least a portion of a length of the corresponding handle 1022 through any number of means such as, for example, sewing, stitching, support elements, webbing, etc. In some embodiments, the bed sheet may include or correspond to any of the bed sheets illustrated in any of FIGS. 1-16, including the bed sheet 100, the bed sheet 400, the bed sheet 602, the bed sheet 700, the bed sheet 806, the bed sheet 900, the bed sheet 1000, and the bed sheet 1010. In some embodiments, the bed sheet 1010 may include or correspond to the first sheet 902, the second sheet 904, or the third sheet 906.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations, and/or additions to the present subject matter as would be readily apparent to one of ordinary skill in the art. It will also be appreciated that elements or components illustrated in the various figures may be combined. For example, a particular bed sheet may include one or more slits 1014, straps 1012, handles 1022, and/or one or more handles 104, as illustrated in FIGS. 1-8C.

What is claimed is:

1. A bed sheet, comprising:

a first sheet have two substantially parallel horizontal edges having a first length, and two substantially parallel vertical edges having a second length, the first length being greater than the second length;

a second sheet having two substantially parallel horizontal edges having a third length, and two substantially parallel vertical edges having a fourth length, the third length being less than the first length, and the fourth length being less than the second length, the second sheet further comprising four chamfered corners, wherein the second sheet comprises an octagonal shape; and a support structure comprising horizontal members and vertical members, said horizontal members having a maximum horizontal length that is greater than the third length and less than the first length, and said vertical members having a maximum vertical length that is greater than the fourth length and less than the second length.

2. The bed sheet of claim 1, wherein the support structure comprises a plurality of webbing strips.

3. The bed sheet of claim 1, wherein at least a portion of the support structure is sewn to the first sheet and the second sheet.

4. The bed sheet of claim 1, wherein the second sheet is approximately equal to a size of an upper surface of a gurney.

5. The bed sheet of claim 1, wherein said support structure further comprises a plurality of horizontal handles forming terminal ends of two or more horizontal members.

6. The bed sheet of claim 5, wherein said terminal ends further comprise a divider located external to a perimeter of the second sheet and within a perimeter of the first sheet.

7. The bed sheet of claim 6, wherein said divider is angled.

8. The bed sheet of claim 1, wherein said support structure further comprises a plurality of vertical handles forming terminal ends of two or more vertical members.

9. The bed sheet of claim 8, wherein said terminal ends further comprise a divider located external to a perimeter of the second sheet and within a perimeter of the first sheet.

10. The bed sheet of claim 1, wherein said support structure further comprises two outermost horizontal members spaced apart at a distance that is approximately equal to the fourth length.

11. The bed sheet of claim 1, wherein the support structure and the second sheet are coupled to the first sheet such that the second sheet is interposed between the support structure and the first sheet.

* * * * *